US011781556B2

(12) United States Patent
Patil et al.

(10) Patent No.: US 11,781,556 B2
(45) Date of Patent: Oct. 10, 2023

(54) HIGH ENERGY DENSITY TURBOMACHINES

(71) Applicant: The Texas A&M University System, College Station, TX (US)

(72) Inventors: Abhay R. Patil, College Station, TX (US); Gerald Morrison, College Station, TX (US); Adolfo Delgado, College Station, TX (US)

(73) Assignee: The Texas A&M University System, College Station, TX (US)

( * ) Notice: Subject to any disclaimer, the term of this patent is extended or adjusted under 35 U.S.C. 154(b) by 270 days.

(21) Appl. No.: 17/271,066

(22) PCT Filed: Aug. 26, 2019

(86) PCT No.: PCT/US2019/048111
§ 371 (c)(1),
(2) Date: Feb. 24, 2021

(87) PCT Pub. No.: WO2020/046799
PCT Pub. Date: Mar. 5, 2020

(65) Prior Publication Data

US 2021/0324869 A1 Oct. 21, 2021

Related U.S. Application Data

(60) Provisional application No. 62/723,185, filed on Aug. 27, 2018.

(51) Int. Cl.
*F04D 29/22* (2006.01)
*F04D 7/02* (2006.01)
(Continued)

(52) U.S. Cl.
CPC ..... *F04D 29/2266* (2013.01); *F04D 7/02* (2013.01); *F04D 13/08* (2013.01); *F04D 29/041* (2013.01);
(Continued)

(58) Field of Classification Search
CPC .. F04D 29/041; F04D 29/051; F04D 29/2266; F04D 29/18; F04D 29/284; F04D 29/286
See application file for complete search history.

(56) References Cited

U.S. PATENT DOCUMENTS 2,835,203 A 5/1958 Cliborn
4,435,193 A * 3/1984 Gullichsen ..... D21D 5/26 96/174
(Continued)

OTHER PUBLICATIONS

Young, Lee W., International Search Report for PCT/US2019/048111, dated Nov. 18, 2019 [1 page].

*Primary Examiner* — Eldon T Brockman
*Assistant Examiner* — Andrew J Marien
(74) *Attorney, Agent, or Firm* — Winstead PC

(57) ABSTRACT

A turbomachine includes a housing having an inlet and an outlet. A shaft is rotationally disposed in the housing. The shaft is rotatable about a longitudinal axis. An impeller is coupled to the shaft between the inlet and the outlet and rotates with the shaft. The impeller includes a single impeller inlet and an impeller outlet, a first set of vanes disposed on a first side of the impeller, and a second set of vanes disposed on a second side of the impeller. A passage is formed through a thickness of the impeller. The passage facilitates transmission of fluid from the first side of the impeller to the second side of the impeller such that fluid is supplied to the first set of vanes and the second set of vanes via the single impeller inlet. Transmission of fluid through the impeller reduces net axial thrust imparted to at least one of the impeller and the shaft.

20 Claims, 28 Drawing Sheets

(51) Int. Cl.

| | |
|---|---|
| ***F04D 13/08*** | (2006.01) |
| ***F04D 29/041*** | (2006.01) |
| ***F04D 29/051*** | (2006.01) |
| ***F04D 29/18*** | (2006.01) |
| ***F04D 29/28*** | (2006.01) |

(52) U.S. Cl.
CPC ..... *F04D 29/051* (2013.01); *F04D 29/18* (2013.01); *F04D 29/284* (2013.01); *F04D 29/286* (2013.01); *F05D 2240/30* (2013.01)

(56) References Cited

U.S. PATENT DOCUMENTS

| | | | | |
|---|---|---|---|---|
| 4,936,744 | A * | 6/1990 | Dosch | D21D 5/26 415/24 |
| 4,981,413 | A | 1/1991 | Elonen et al. | |
| 5,078,573 | A * | 1/1992 | Peroaho | F04D 7/045 417/69 |
| 5,545,005 | A | 8/1996 | Stahle | |
| 8,444,370 | B2 | 5/2013 | Gulich | |
| 9,115,725 | B2 * | 8/2015 | Haefliger | F04D 13/0633 |
| 2008/0213093 | A1 | 9/2008 | Guelich | |
| 2011/0095541 | A1 * | 4/2011 | Baeuerle | F23R 3/286 290/1 A |
| 2013/0022449 | A1 * | 1/2013 | Japikse | F01D 17/143 415/207 |
| 2014/0178190 | A1 | 6/2014 | Gahlot et al. | |
| 2015/0267711 | A1 | 9/2015 | Elebiary et al. | |
| 2016/0195094 | A1 * | 7/2016 | Yamashita | F04D 29/284 416/204 R |
| 2017/0022993 | A1 * | 1/2017 | Eckl | F01D 25/243 |
| 2021/0033000 | A1 * | 2/2021 | Pfeiffer | H02K 7/09 |

* cited by examiner

HIGH ENERGY DENSITY TURBOMACHINES

CROSS-REFERENCE TO RELATED APPLICATIONS

This application claims priority to, and incorporates by reference the entire disclosure of, U.S. Provisional Patent Application No. 62/723,185 filed on Aug. 27, 2018.

BACKGROUND

This section provides background information to facilitate a better understanding of the various aspects of the disclosure. It should be understood that the statements in this section of this document are to be read in this light, and not as admissions of prior art.

Turbomachinery is a term used to describe mechanical devices that transfer energy between a rotor and a fluid. Turbomachines may be power-absorbing devices, such as pumps and compressors, or may be power-producing devices such as turbines. Power-absorbing turbomachines typically transfer energy from a rotor to a fluid while power-producing turbomachines typically transfer energy from a fluid to a rotor.

SUMMARY

Various aspects of the disclosure relate to a turbomachine. The turbomachine includes a housing having an inlet and an outlet. A shaft is rotationally disposed in the housing. The shaft is rotatable about a longitudinal axis. An impeller is coupled to the shaft between the inlet and the outlet and rotates with the shaft. The impeller includes a single impeller inlet and an impeller outlet, a first set of vanes disposed on a first side of the impeller, and a second set of vanes disposed on a second side of the impeller. A passage is formed through a thickness of the impeller. The passage facilitates transmission of fluid from the first side of the impeller to the second side of the impeller such that fluid is supplied to the first set of vanes and the second set of vanes via the single impeller inlet. Transmission of fluid through the impeller reduces net axial thrust imparted to at least one of the impeller and the shaft.

Various aspects of the disclosure relate to an impeller for use in a turbomachine. The impeller includes a first side having a first set of vanes disposed thereon and a second side having a second set of vanes disposed thereon. The second side is arranged opposite the first side. The impeller includes a single fluid inlet and a fluid outlet. A passage is formed through a thickness of the impeller. The passage facilitates transmission of fluid from the first side of the impeller to the second side of the impeller such that fluid is supplied to the first set of vanes and the second set of vanes via the single impeller inlet.

Various aspects of the disclosure relate to a method of reducing axial thrust on an impeller shaft. The method includes directing a fluid onto a first side of an impeller and a second side of an impeller via a single impeller inlet. The method also includes transmitting the fluid through a passage formed through a thickness of the impeller between the first side of the impeller and the second side of the impeller. The fluid is expelled from the impeller via an impeller outlet. Various aspects of the disclosure relate a method of assembling an impeller in a single-stage or multistage turbomachine so as to allow radial and axial position adjustment of the impeller during operation.

This summary is provided to introduce a selection of concepts that are further described below in the detailed description. This summary is not intended to identify key or essential features of the claimed subject matter, nor is it intended to be used as an aid in limiting the scope of claimed subject matter.

BRIEF DESCRIPTION OF THE DRAWINGS

For a more complete understanding of the present disclosure and for further objects and advantages thereof, reference may now be had to the following description taken in conjunction with the accompanying drawings in which.

DETAILED DESCRIPTION

Various embodiments will now be described more fully with reference to the accompanying drawings. The disclosure may, however, be embodied in many different forms and should not be construed as limited to the embodiments set forth herein.

Turbomachines such as pumps and compressors are power absorbing devices used to add energy to fluids such as, for example, gases, liquids, or multiphase fluids that include at least one of gases, solids, and liquids. Turbomachines such as hydraulic and pneumatic turbines are power-producing devices used to generate mechanical or electrical power from hydraulic or pneumatic energy. A factor affecting reliability and feasibility of employing multistage turbomachines is the turbomachine's ability to handle reactive forces such as axial thrusts and radial loads. Hydraulic design of the impeller includes a shape of the impeller vanes and an ability of the impeller to tolerate axial and radial loading during operation. The axial thrust and radial loads limit rotational speed and operational spans of the turbomachine. In various embodiments, a turbomachine includes an impeller having an annular passage formed therein to balance thrust forces acting on the impeller shaft at elevated rotational speeds. Shrouded impeller designs allow axial and radial repositioning during assembly and operation. Such a turbomachine lowers axial thrust values and handles radial loads effectively compared to traditional turbomachine designs thereby increasing a threshold speed limit and dynamic stability of the turbomachine.

Figure 1:
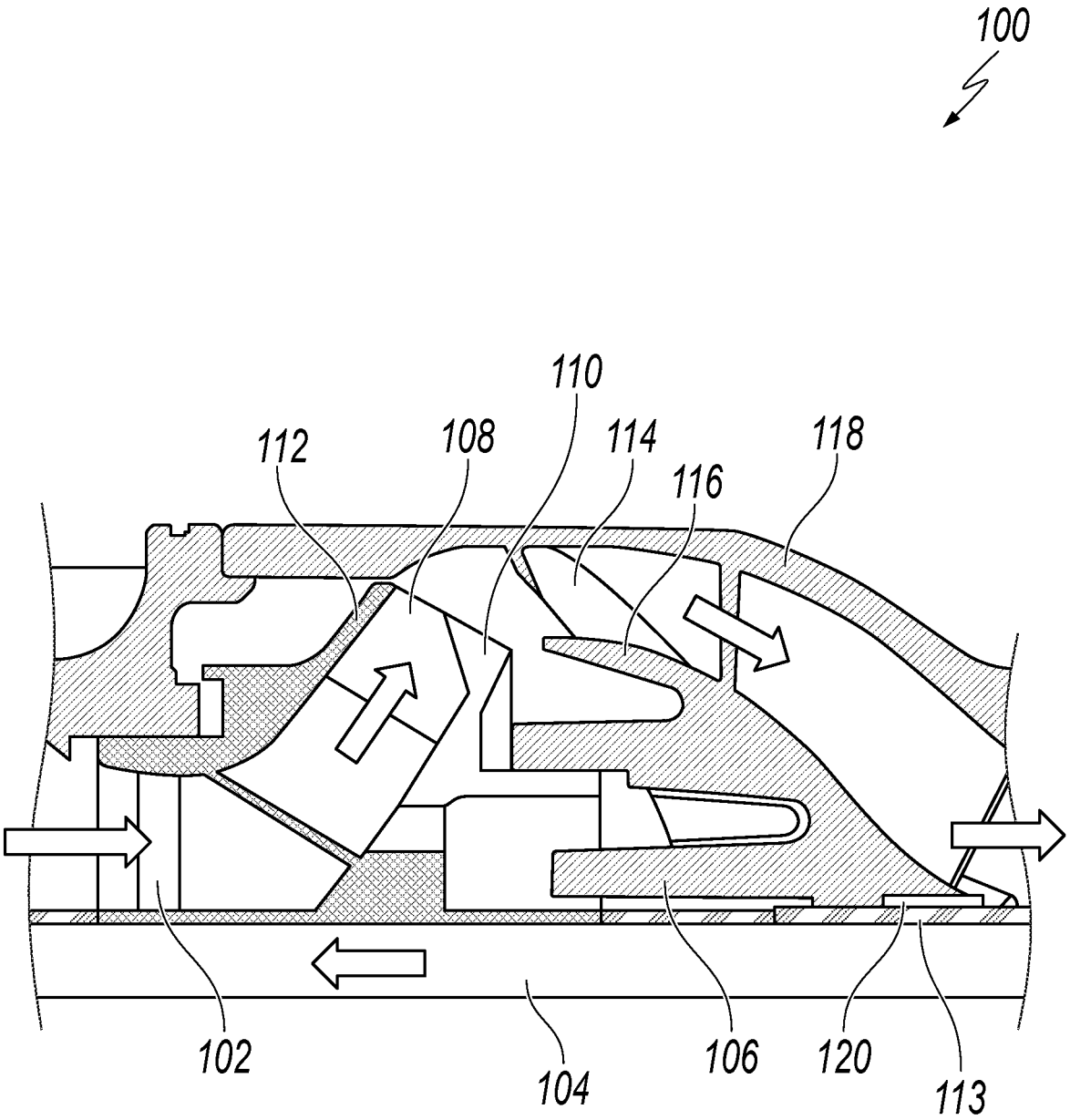
FIG. 1 is a cross-sectional view of a single suction multi-stage electrical submersible pump.

FIG. 1 is a cross-sectional view of a single suction multi-stage electrical submersible pump 100. The electrical submersible pump 100 includes rotating elements such as an impeller 102 driven by a shaft 104 and a journal 113 on the shaft 104. The impeller 102 includes a hub 110 and at least one vane 108 that is mounted to the hub 110. An impeller shroud 112 is disposed on an upstream side of the impeller 102 and conceals the at least one vane 108. In various embodiments, however, the impeller shroud 112 could be omitted. The rotating elements are supported by a stationary bushing 120 installed in a diffuser 106. The diffuser 106 includes at least one diffuser vane 114 that is mounted on a diffuser hub 116. A diffuser shroud 118 is positioned downstream of the at least one vane 114 and conceals the at least one vane 114. The diffuser 106 is stationary and redirects the fluid flow to an inlet of the next stage impeller. During operation, the electrical submersible pump 100 causes a pressure differential between an input (i.e. suction) side and an output (i.e. discharge) side. Such a pressure differential causes significant axial loading on the shaft 104, the journal 113, and the stationary bushing 120. Over time, the axial loading can result in premature wear and failure of components of the electrical submersible pump 100 leading to costly repairs and component replacement.

Figure 2:
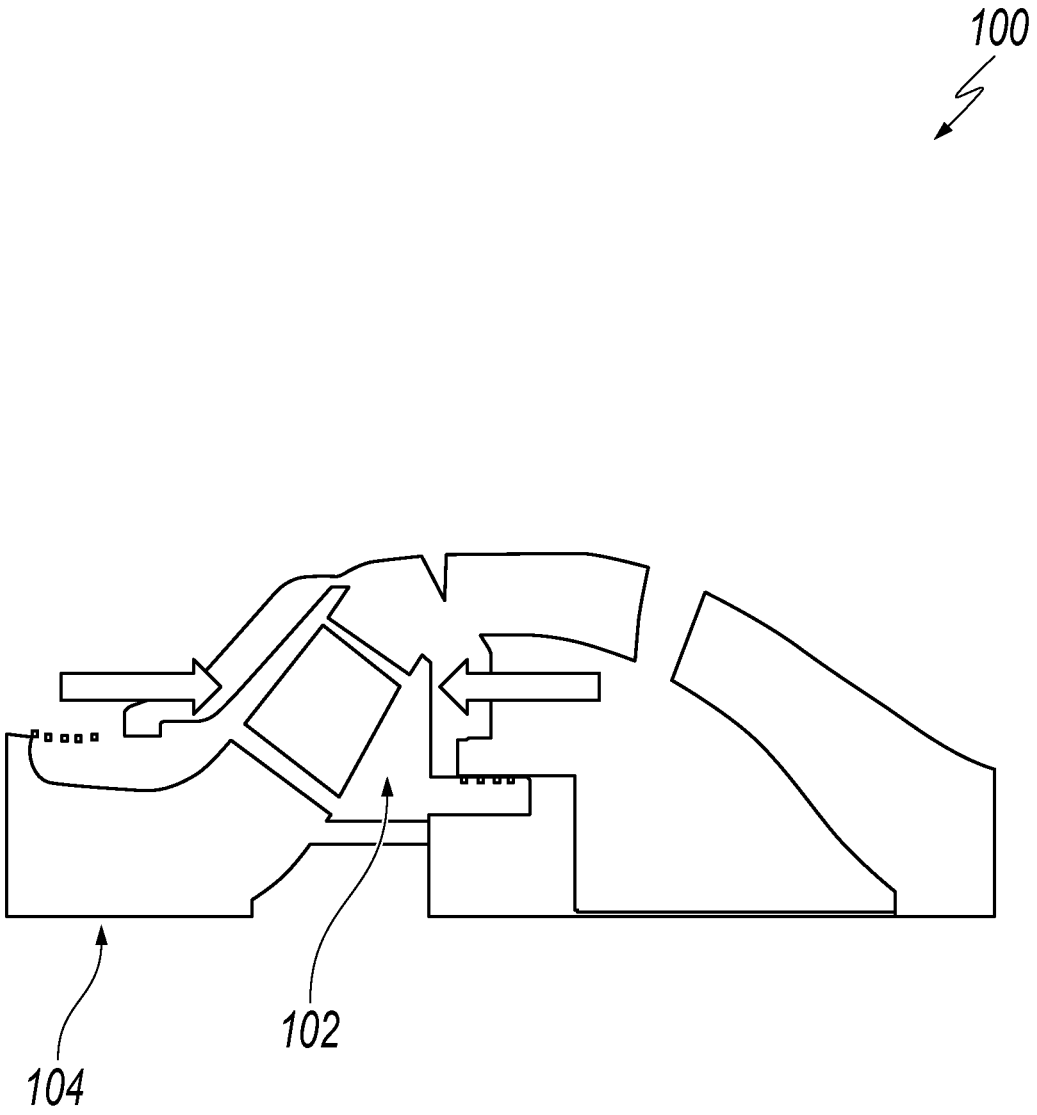
FIG. 2 is a diagram illustrating stage clearances and pressure contour for the single suction multi-stage electrical submersible pump of FIG. 1.

FIG. 2 is a diagram illustrating stage clearances and pressure contour for the single suction multi-stage electrical submersible pump 100. Due to rotation of the impeller 102, fluid pressure is boosted at an output side and causes a pressure differential between an input pressure and an output pressure. Due to the difference between inlet and outlet pressure, axial thrust is exerted on the impeller 102 as shown in FIG. 2. The axial thrust is transmitted to a thrust bearing via the shaft 104.

Figure 3:
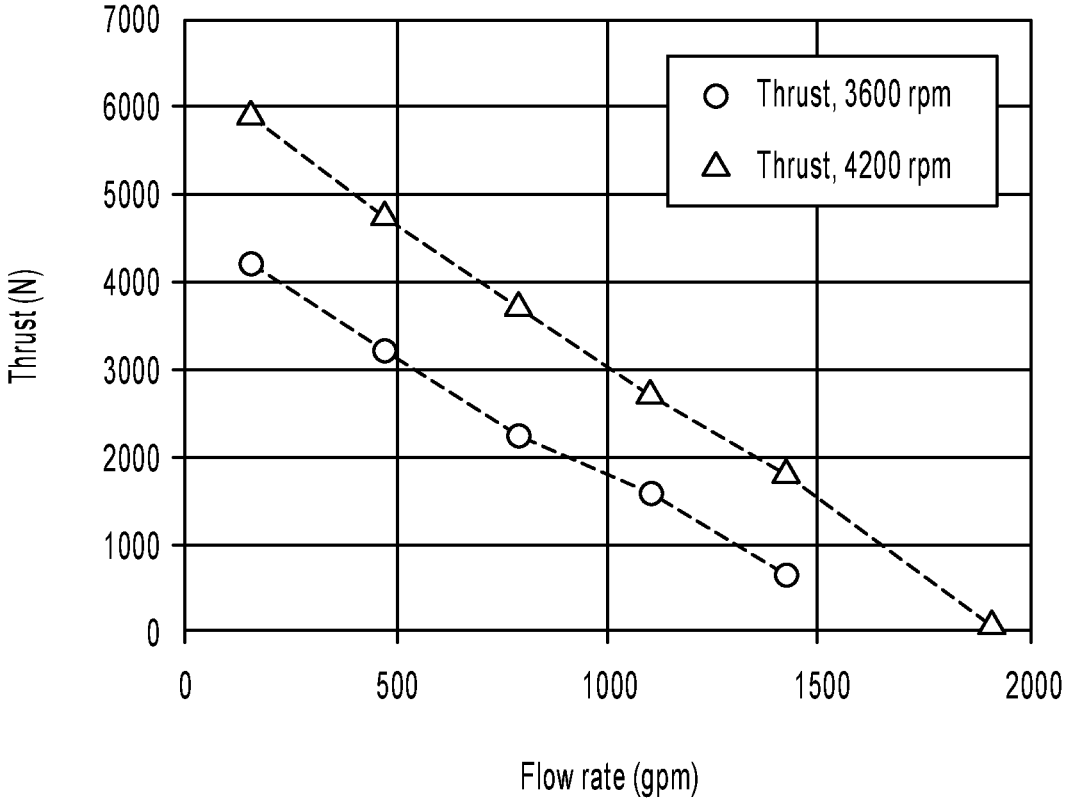
FIG. 3 is a graph illustrating thrust change with rotational speed for a single suction multi-stage electrical submersible pump.

FIG. 3 is a graph illustrating variation in axial thrust with rotational speed for the single suction multi-stage electrical submersible pump 100. Line 302 illustrates variation of flow rate with thrust at 4,200 rpm. Line 304 illustrates variation of flow rate with thrust at 3,600 rpm. To boost production or maintain a desired fluid flow rate, a rotational speed of the impeller 102 is increased. Such an increase in rotational speed of the impeller 102 increases an output pressure head. Consequently, as shown in FIG. 3, the axial thrust values are increased. Axial thrust values on the shaft 104 limit the operational span of the single suction multi-stage electrical submersible pump 100 at higher rotational speeds.

Figure 4A:
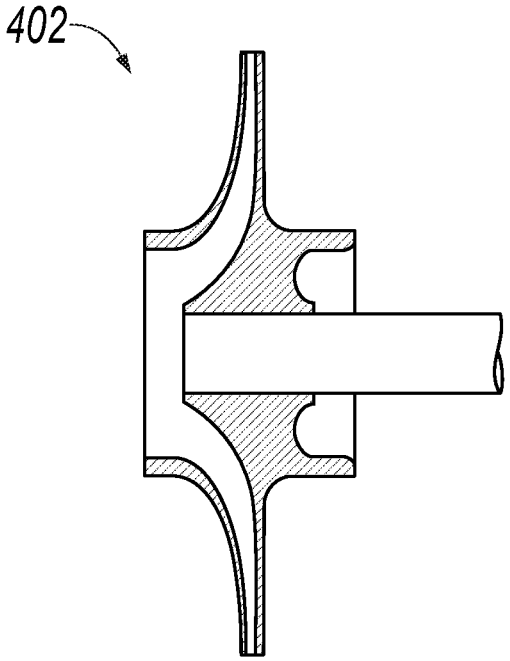
FIG. 4A is a cross sectional view of a single-suction impeller design.
Figure 4B:
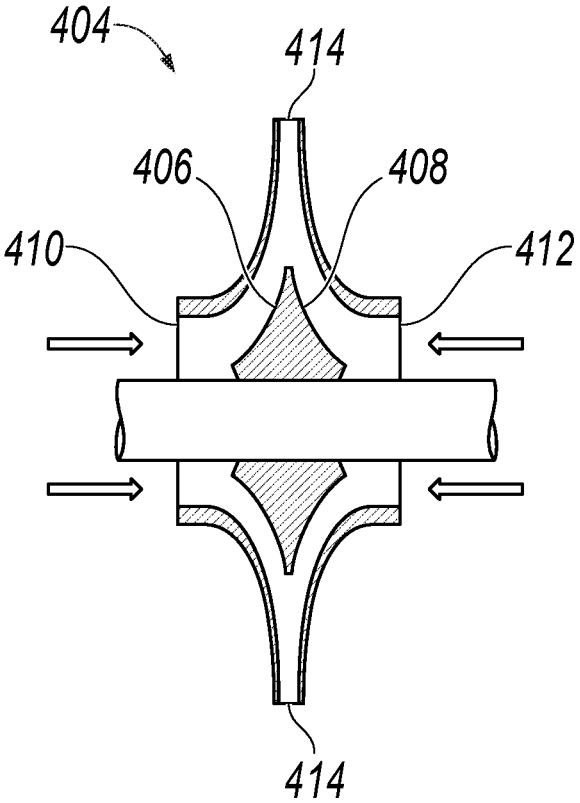
FIG. 4B is a cross sectional view of a double-suction impeller design.

FIG. 4A illustrates a single suction impeller 402 where fluid is drawn from one side of the impeller 402. In contrast, FIG. 4B illustrates a double suction impeller 404 designed to draw fluid flow from a first side 406 and a second side 408 of the impeller 404. Thus, the double suction impeller 404 has a first inlet 410, a second inlet 412 and one outlet 414. The double suction impeller 404 reduces axial thrust on the shaft 104, while also allowing higher flows than the single suction impeller 402. However, the double suction impeller 404 is not feasible for downhole multistage pumps or compressors since it requires the first inlet 410 and the second inlet 412 on opposite sides, which increases a size of a housing.

Figure 5:
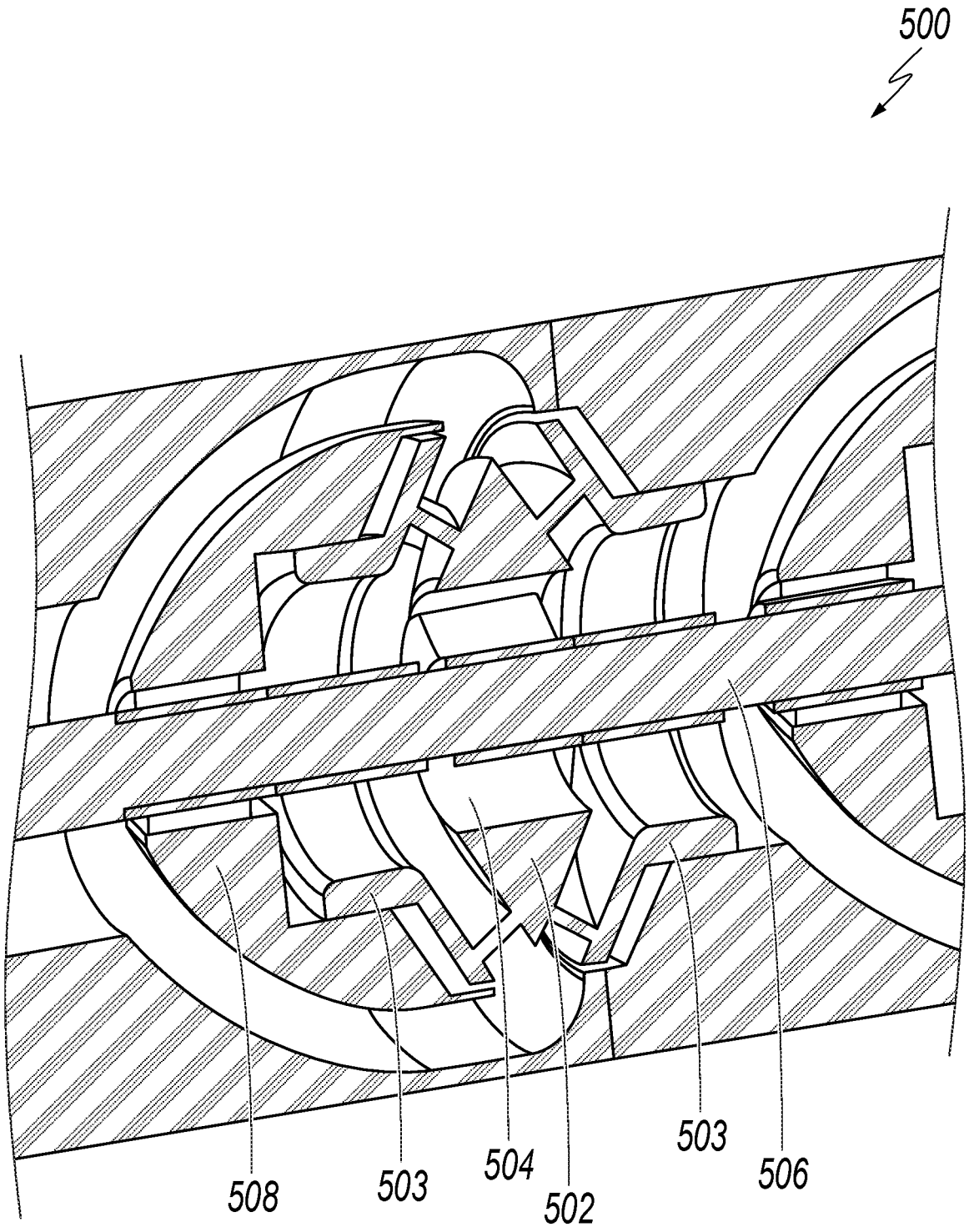
FIG. 5 is a cross-sectional view of a turbomachine having an impeller with an annular passage according to aspects of the disclosure.
Figure 6:
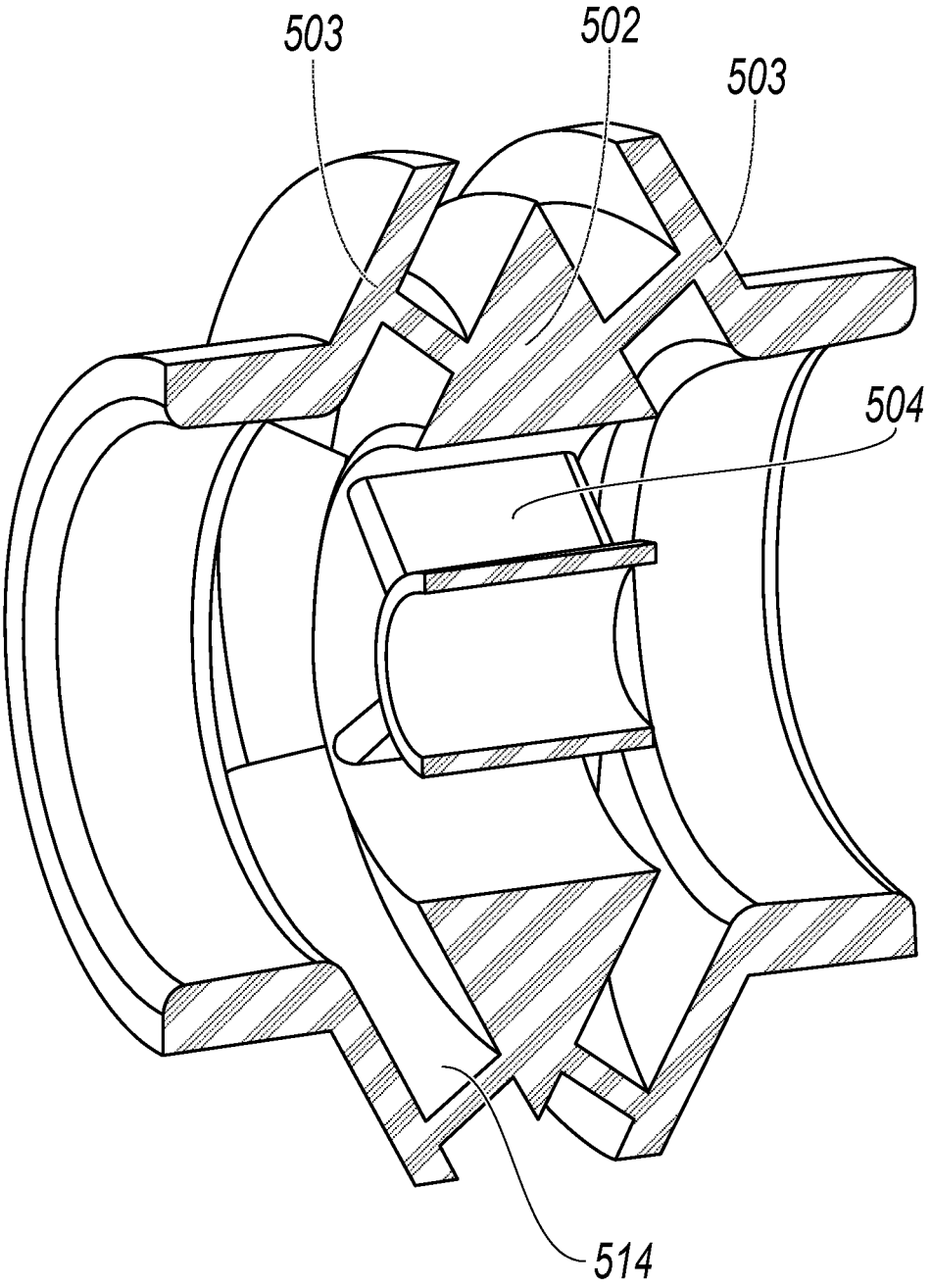
FIG. 6 is a cross sectional view of an impeller with an annular passage utilized with the turbomachine of FIG. 5 according to aspects of the disclosure.

FIG. 5 is a cross-sectional view of a turbomachine 500 having an impeller 502 with an annular passage 504. FIG. 6 is a cross sectional view of the impeller 502 with the annular passage 504 utilized with the turbomachine 500. Referring to FIGS. 5-6, the turbomachine 500 draws fluid from one direction. Pumping is accomplished from both the sides of an impeller 502. The turbomachine 500 balances the thrust forces acting on the shaft 506. A shrouded design of the impeller 502 facilitates an axial positioning clearance, which allows use of the turbomachine 500 as a downhole multi-stage pump. A shrouded design of the impeller 502 forms a seal between stationary and rotating parts and acts as a radial load support on the impeller 502. The turbomachine 500 increases the threshold rotational speed and improves stability.

Figure 7A:
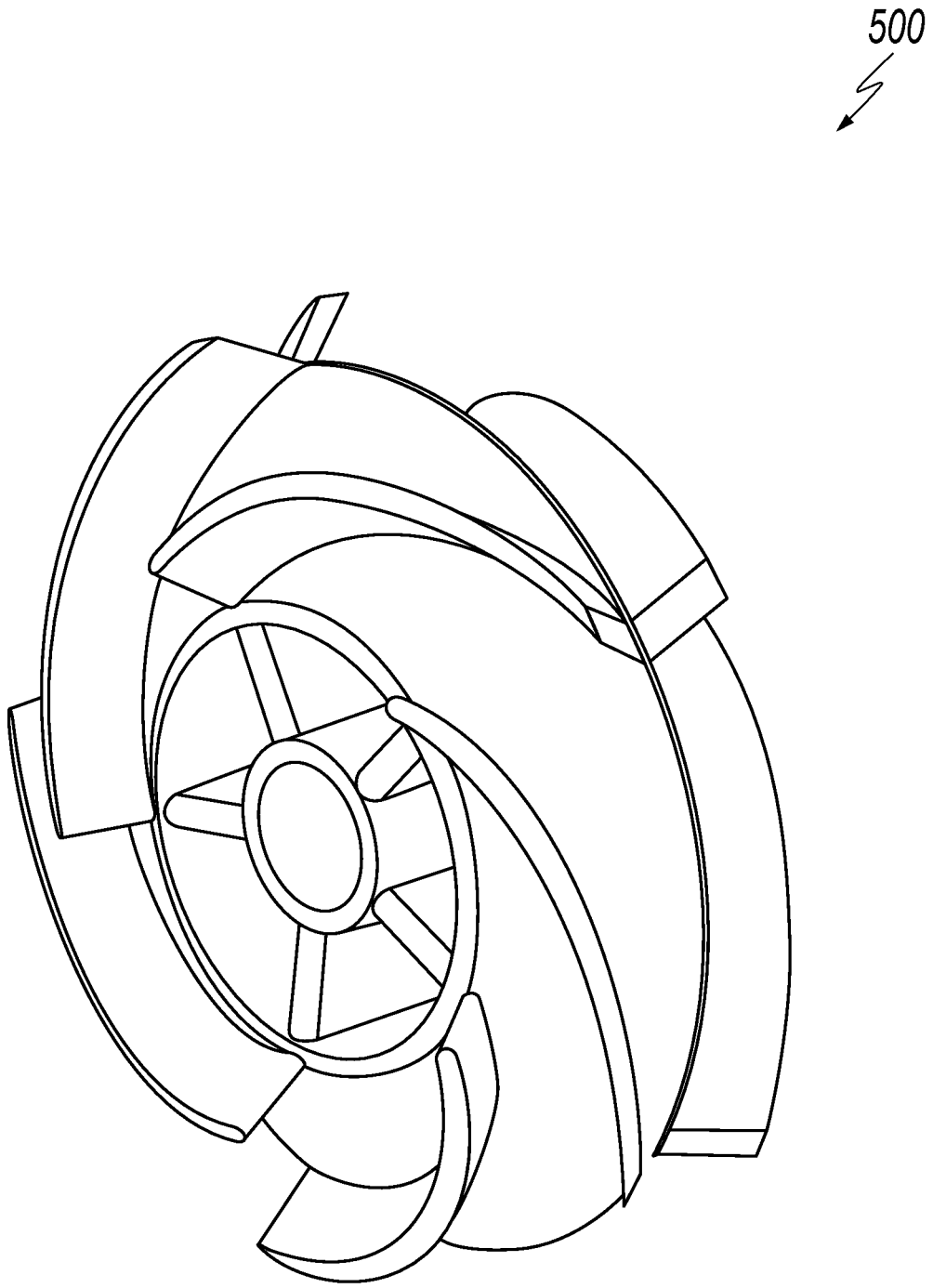
FIG. 7A is a perspective view of an unshrouded impeller utilized with the turbomachine of FIG. 5 according to aspects of the disclosure.

The turbomachine 500 includes an impeller 502 and a diffuser 508. The impeller 502 is designed in such a way that flow is drawn from one side; however, the impeller 502 allows flow to be divided and passed through both sides of the impeller 502, thereby allowing the axial thrust forces acting on the shaft 506 to be balanced in a manner similar to the double suction impeller 404. In various embodiments, the impeller 502 includes an impeller shroud 503; however, in other embodiments, the impeller shroud 503 may be omitted and the impeller 502 may be unshrouded. An example of an unshrouded impeller 550 is illustrated in FIG. 7A. In various embodiments, the impeller shroud 503 mechanically supports a vane 514 and isolates a higher pressure region 510 of the turbomachine 500 from a lower pressure region 512 of the turbomachine 500. In this manner, the impeller shroud 503 reduces a leakage flow rate of fluid passing through the turbomachine 500, thereby increasing an efficiency of the turbomachine 500. Further, an impeller shroud skirt 516 acts as a bearing support by supporting the impeller 502 using the diffuser 508 surface against the radial loads or side loads. During use, unshrouded impellers carry a risk of the impeller 502 contacting the housing and generating sparks. This risk generally makes unshrouded impellers best suited for handling water and other non-volatile fluids. In contrast, use of the impeller shroud 503 facilitates better handling of volatile fluids than unshrouded impellers due to the fact that it is the shroud 503 that will contact the housing if the shaft 506 displaces from centerline. Because of this, impellers 502 having the shroud 503 are often utilized, for example, in oil and gas production and other applications involving volatile fluids.

Figure 7B:
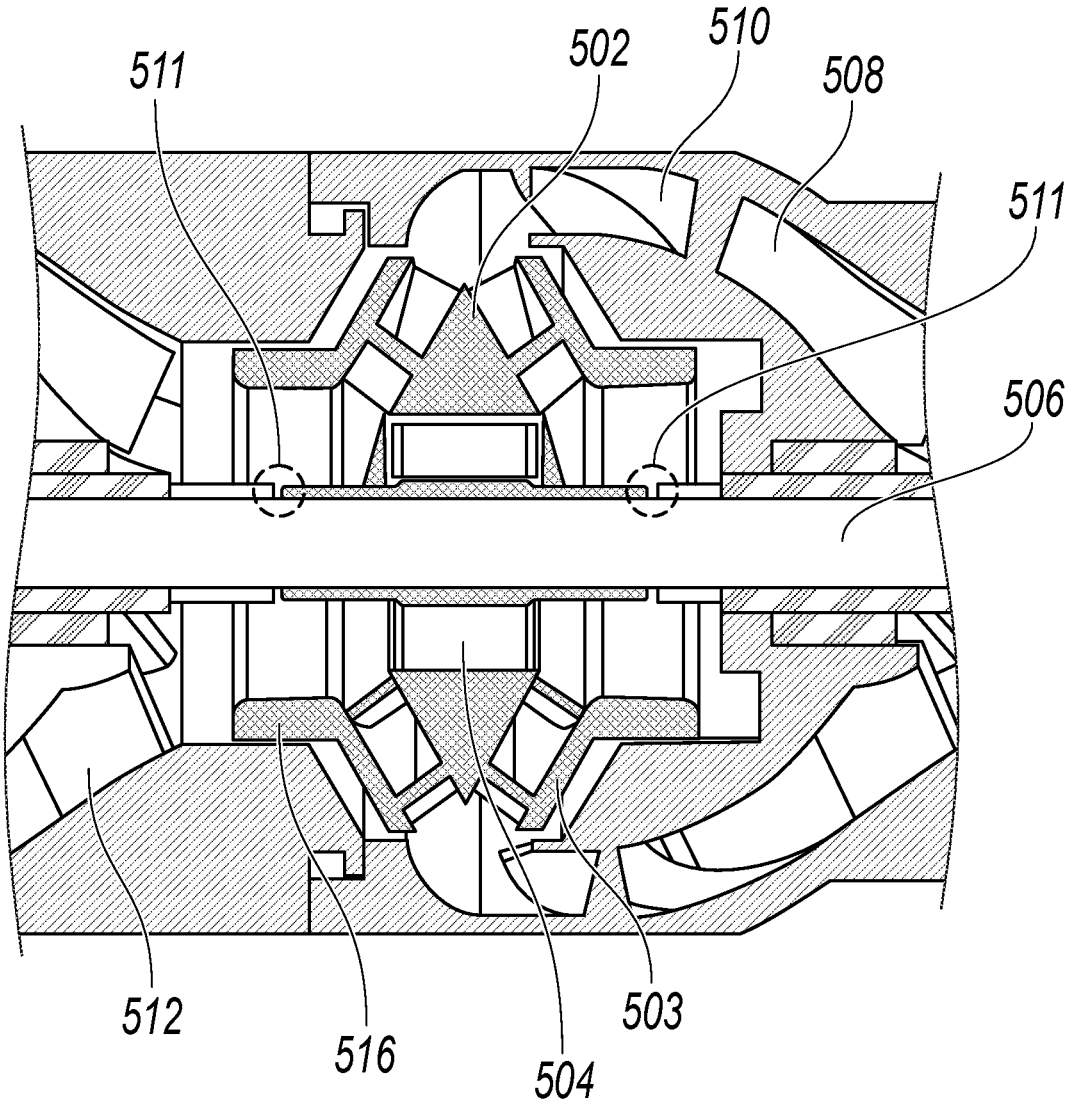
FIG. 7B is a cross-sectional view of the turbomachine of FIG. 5 illustrating a shrouded impeller.

FIG. 7B illustrates a cross sectional view of an impeller 502 having an impeller shroud 503. Impellers 502 having the shroud 503 are less sensitive to axial positioning and can compensate for thermal expansion of the shaft 506. In various embodiments, a clearance space 511 is defined on either side of the impeller 502 between the impeller hub 110 and the journal 113. The clearance space 511 allows the impeller 502 to float axially on the shaft 506 in response to changes in axial force. The impeller 502 has means for fluid transmission formed therein which facilitates transmission of fluid through the clearance formed between the impeller 502 and the diffuser 508. In various embodiments, the means for transmission include an annular passage 504 formed through a thickness of the impeller 502 in order to facilitate passage of fluids from a first side of the impeller 502 to a second side of the impeller 502. Passage of liquids through the impeller 502 facilitates fluid flow on both sides of the impeller 502 and balances thrust forces acting on the shaft 506. While the impeller 502 is described and shown herein as being utilized in conjunction with a power-absorbing turbomachine, such as pumps and compressors, it will be recognized that an impeller of a similar design could also be utilized in conjunction with power-producing turbomachines such as, for example, turbines. In various embodiments, the impeller 502 may be operated in single phase or multi-phase flow conditions having mixtures of liquids, gases, solids, and combinations thereof.

Figure 8:
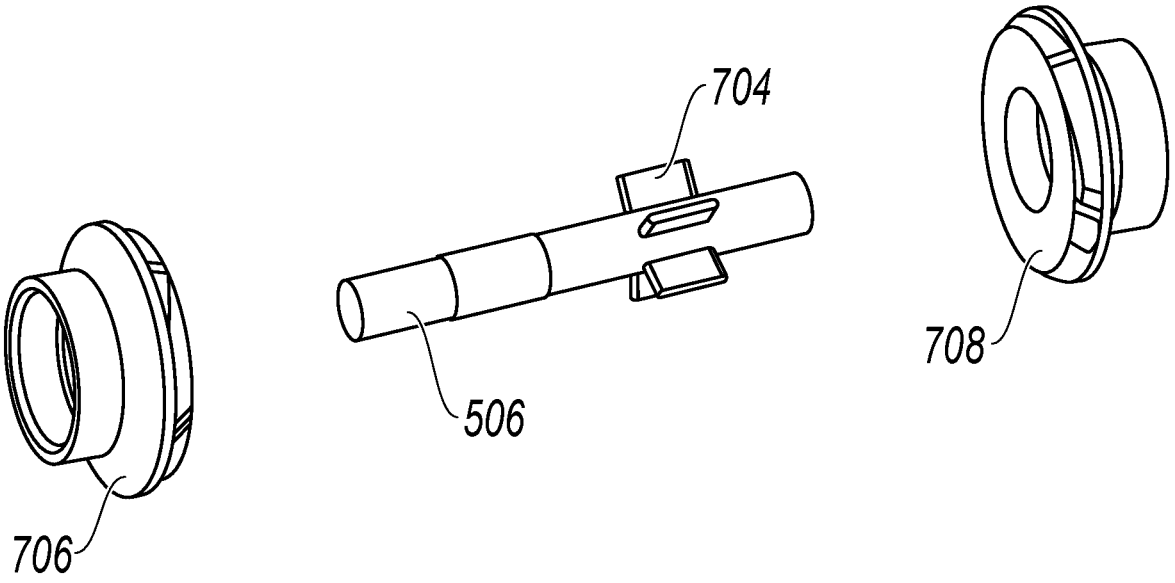
FIG. 8 is an exploded view of a turbomachine shaft assembly according to aspects of the disclosure.

FIG. 8 is an exploded view of the shaft 506. The shaft 506 includes ribs 704 formed thereon. A first impeller side 706 is received onto the shaft 506 and a second impeller side 708 is received onto the shaft 506. The first impeller side 706 and the second impeller side 708 are coupled to each other to form the impeller 502 and are coupled to the shaft 506 via the ribs 704. In various embodiments, the ribs 704 may have an aero foil shape. The first impeller side 706 and the second impeller side 708 may be shrouded or unshrouded. In various embodiments, vanes of the first impeller side 706 may include vanes with a shape, pitch, angle, and profile that is either the same or different from the vanes of the second impeller side 708. In various embodiments, the first impeller side 706 and the second impeller side 708 include vanes 711 extend radially from the shaft 506. In various embodiments, the vanes 711 are arranged at an angle other than 90 degrees relative to the shaft 506. Arrangement of the vanes 711 relative to the shaft 506 at non-90-degree angles imparts several benefits to the turbomachine 500. First, arrangement of the vanes 711 at non-90-degree angles facilitates better handling of multiphase fluid flow than vanes that are arranged at 90-degree angles. Additionally, arrangement of the vanes 711 at non-90-degree angles allows the turbomachine 500 to handle concentrations of solid particulates, such as for example, sand, which may be entrained in the fluid. Also, arrangement of the vanes 711 at non-90-degree angles facilitates better pressure loading on the vanes 711. In this regard, pressure gradually increases on the vane 711 unlike 90-degree vanes, which can exhibit areas of pressure concentration. These features of non-90-degree arrangement of the vanes 711 facilitate better reliability and longer service life than impellers having vanes arranged at 90-degree angles under multiphase flow conditions.

Figure 9A:
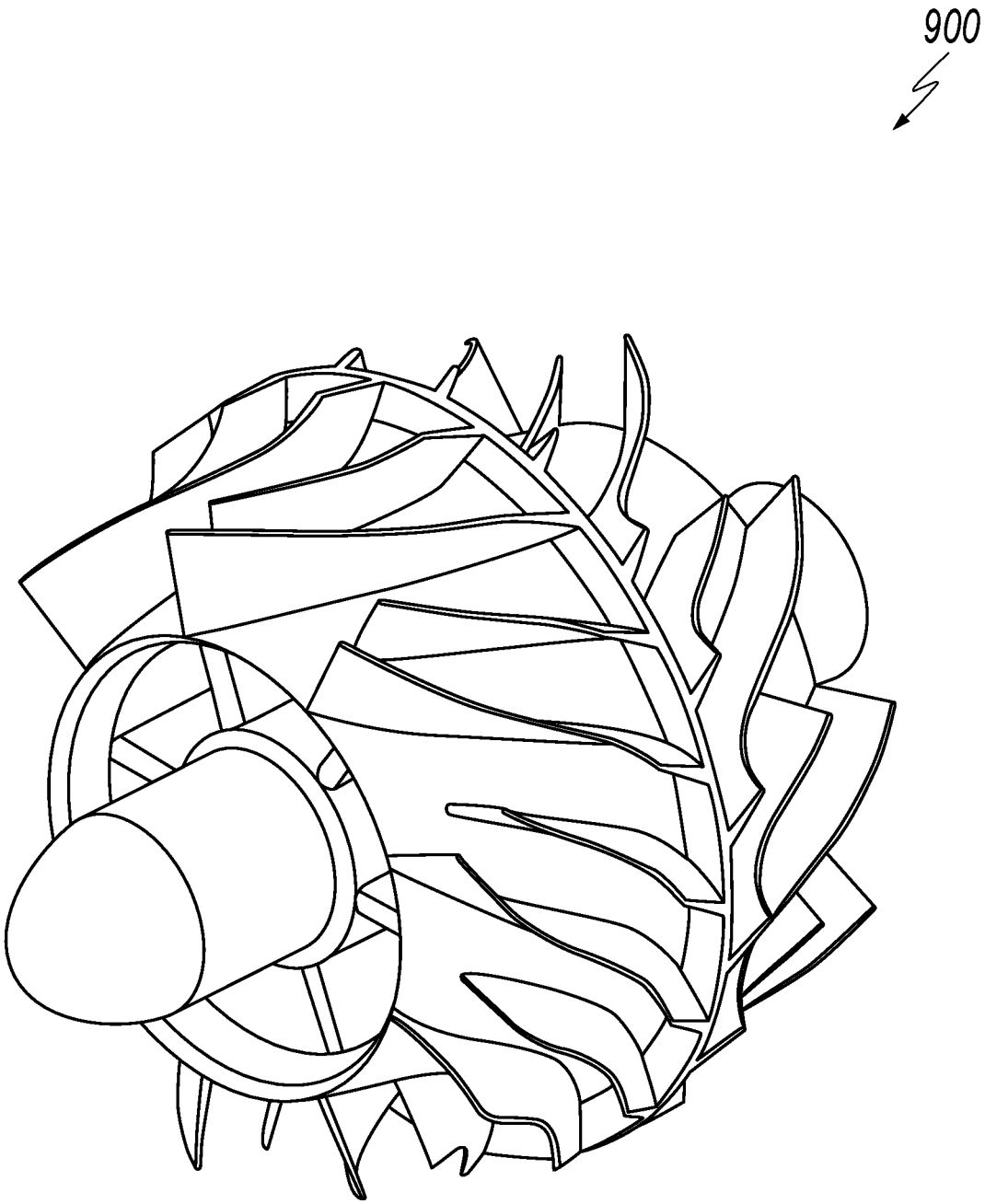
FIG. 9A is a perspective view of an exemplary unshrouded impeller for a compressor according to aspects of the disclosure.
Figure 9B:
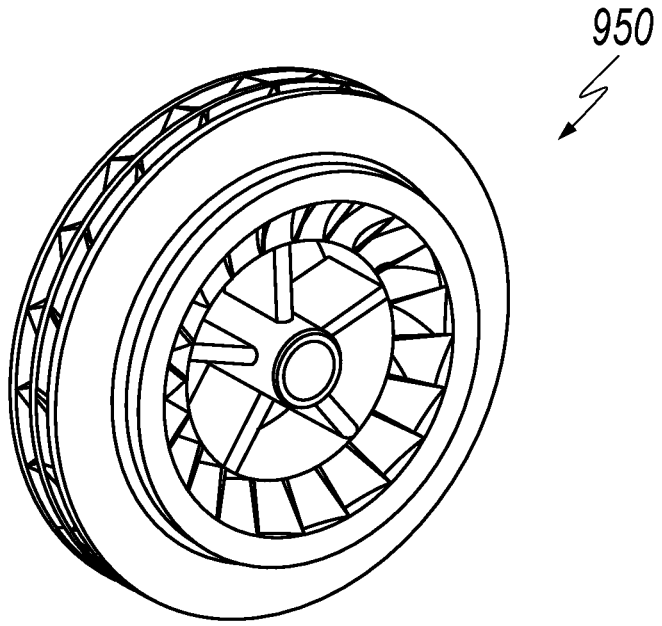
FIG. 9B is a perspective view of an exemplary shrouded impeller for use with a compressor.
Figure 9C:
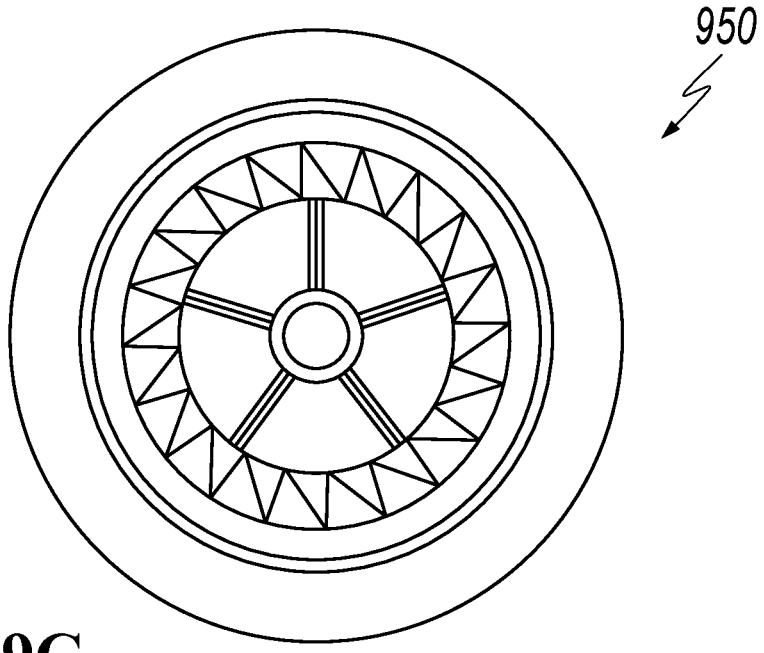
FIG. 9C is a plan view of the shrouded impeller of FIG. 9B.
Figure 9D:
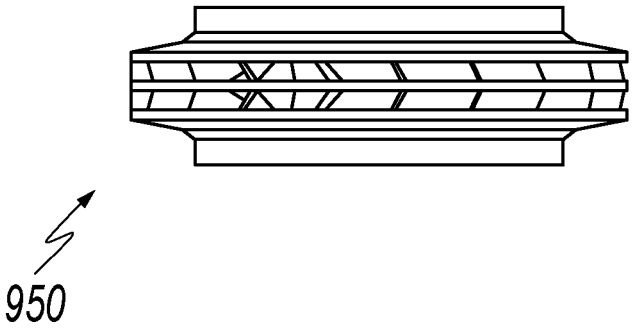
FIG. 9D is a side view of the shrouded impeller of FIG. 9B.
Figure 9E:
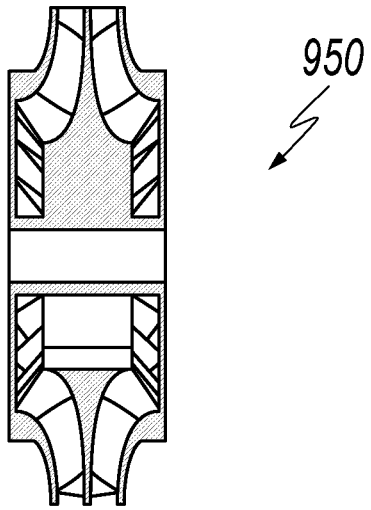
FIG. 9E is a cross-sectional view of the shrouded impeller of FIG. 9B.
Figure 9F:
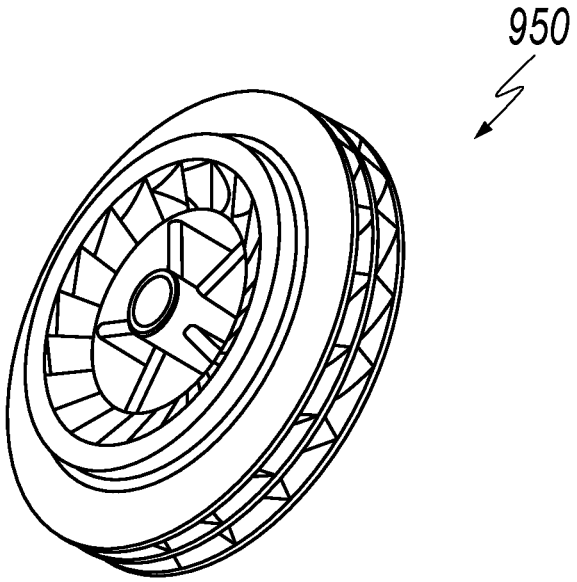
FIG. 9F is perspective view of the shrouded impeller of FIG. 9B.

FIG. 9A is a perspective view of an unshrouded impeller 900 (also referred to as an "open impeller") for a compressor. The impeller 900 as shown in the FIG. 9 is unshrouded; however, in other embodiments, the impeller 900 may be shrouded (also referred to as a "closed impeller") or unshrouded. FIG. 9B is a perspective view of a shrouded impeller 950 for use with a compressor. FIG. 9C is a plan view of the shrouded impeller 950. FIG. 9D is a side view of the shrouded impeller 950. FIG. 9E is a cross-sectional view of the shrouded impeller 950. FIG. 9F is perspective view of the shrouded impeller 950. In various embodiments, the minimum specific rotational speed of an unshrouded impeller is approximately 20 revolutions per minute while the minimum specific rotational speed of a shrouded impeller is approximately 2 revolutions per minute. During operation, unshrouded impellers rely on a clearance between a front edge of the vanes and the housing for maintaining efficiency. In various embodiments, the diffuser can be vanned or vaneless which will accommodate the shrouded/unshrouded impeller 900. In the case of a multistage compressor, the diffuser 508 will direct the flow to next impeller stage similar to the turbomachine 500 illustrated in FIG. 5. Support ribs connecting two sides can be plain (no axial thrust) or aerodynamic design such as, for example, an aero foil or helical shape that allows some energy conversion. However, aerofoil/helical design will generate some axial thrust. In various embodiments, the vane profile of the impeller 900 may be continuous or split and the impeller 900 may or may not include balance holes such as, for example, balance holes 1004 and 1104 shown in FIGS. 10-11A. In various embodiments, vane inlet and exit angles on both sides of the impeller 900 can be the same or different. In various embodiments, vane profiles, shapes, and sizes can be the same or different on both sides of the impeller. In various embodiments, the vanes can be aligned or at any angle. As shown in FIGS. 11B-11F, vanes 1152 having differing length, width, and thickness may be used on opposite sides of the impeller 900. Further, the ribs 1102 that connect the shaft 104 to the impeller 900 may have any length, width, thickness, and number. In various embodiments, flow rates across the two sides of the impeller 900 may be divided equally or unequally. Furthermore, a pressure differential may be created between the first impeller side 706 and the second impeller side 708 facilitating transmission of a first fluid phase on the first impeller side 706 and transmission of a second fluid phase on a second impeller side 708. In other embodiments, the impeller 900 employing aspects of the disclosure may be utilized in conjunction with conventional impellers in multi-stage turbomachines. In still other embodiments, turbomachines employing the impeller 900 may function as, for example, a compressor, a pump, or a turbine.

Figure 10:
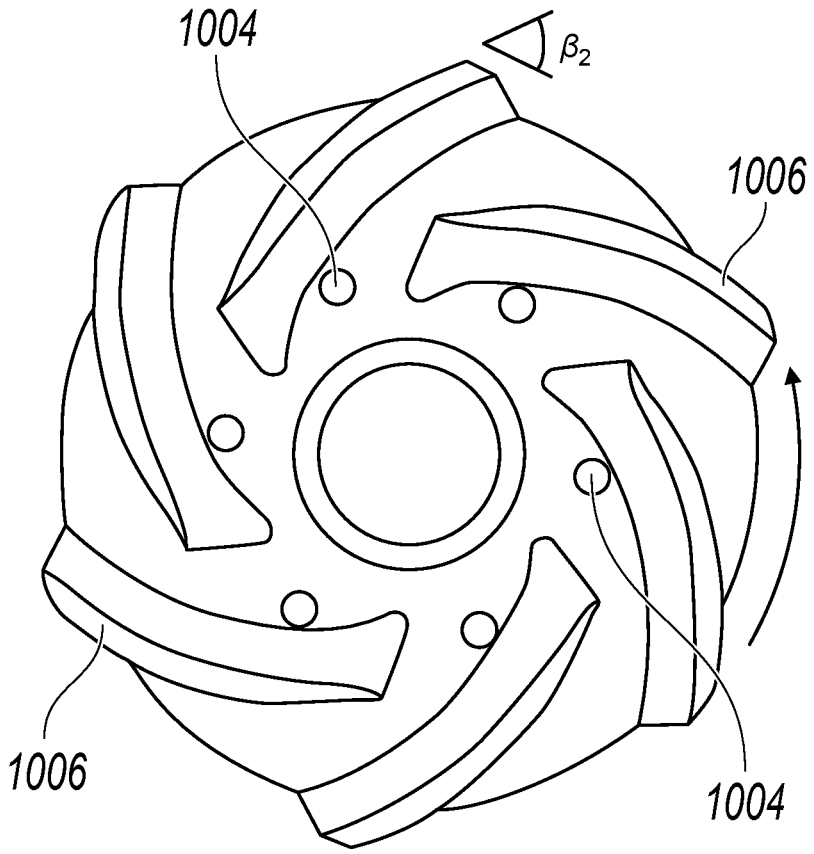
FIG. 10 is a plan view of an impeller utilizing balance holes according to aspects of the disclosure.

FIG. 10 is a plan view of an impeller 1002 utilizing balance holes 1004. The impeller 1002 includes continuous vanes 1006 that extend radially in a curved fashion from a central hub 1008. Balance holes 1004 are formed through the impeller 1002 and facilitate balance of pressure between a first side of the impeller 1002 and a second side of the impeller 1002. The impeller 1002 includes an exit angle $\beta_2$ of less than 90 degrees, which mitigates erosion of the vanes 1006 of the impeller 1002 due to entrainment of solid particulates in the fluid.

Figure 11A:
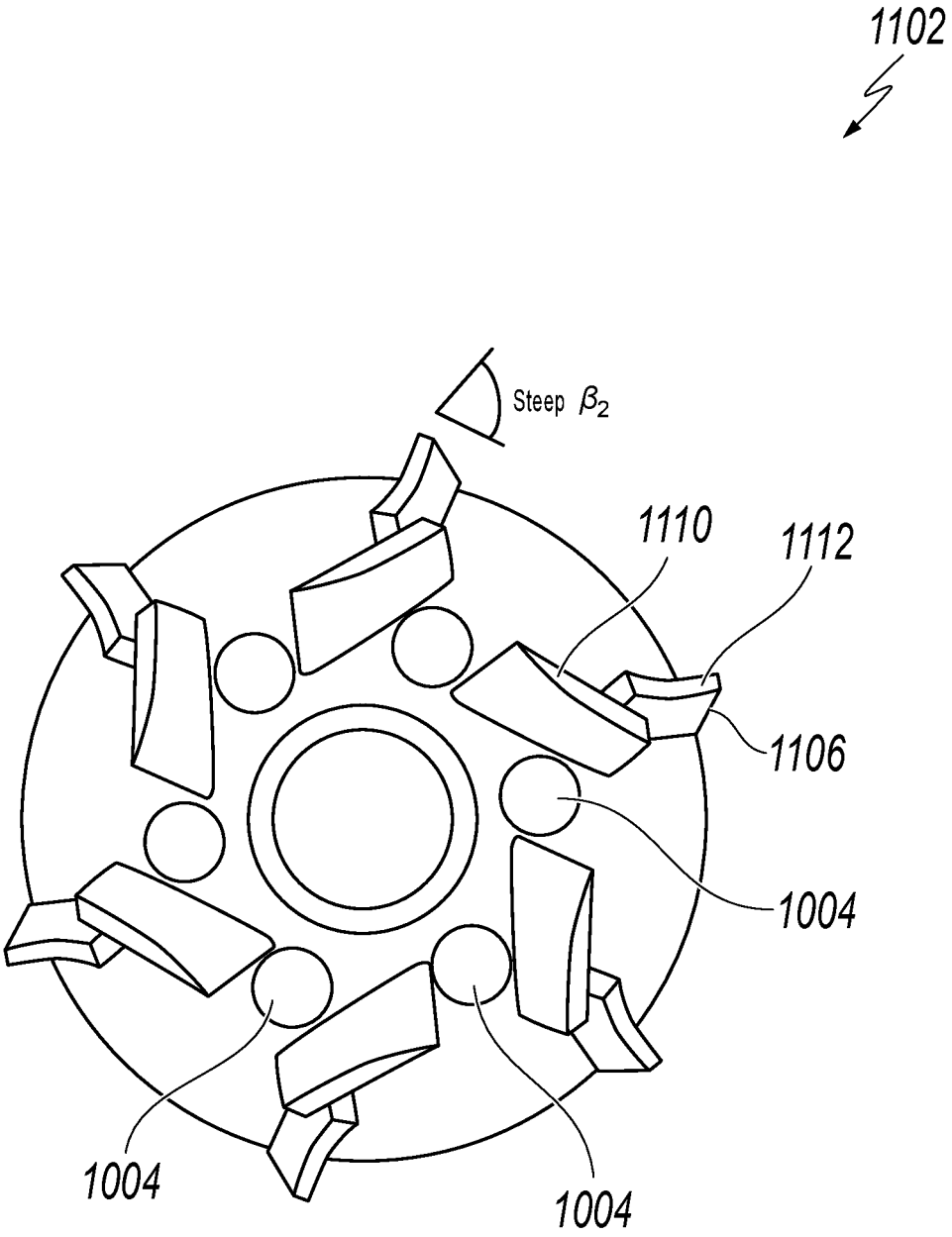
FIG. 11A is a plan view of a split blade impeller according to aspects of the disclosure.
Figure 11B:
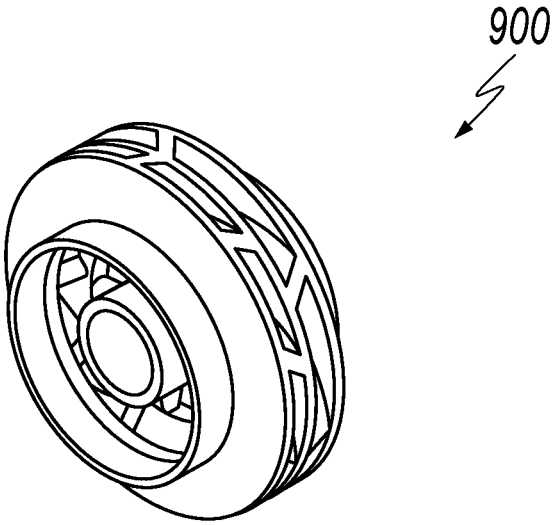
FIGS. 11B-11F illustrate an impeller having differing vane geometry on opposite sides thereof according to aspects of the disclosure.
Figure 11C:
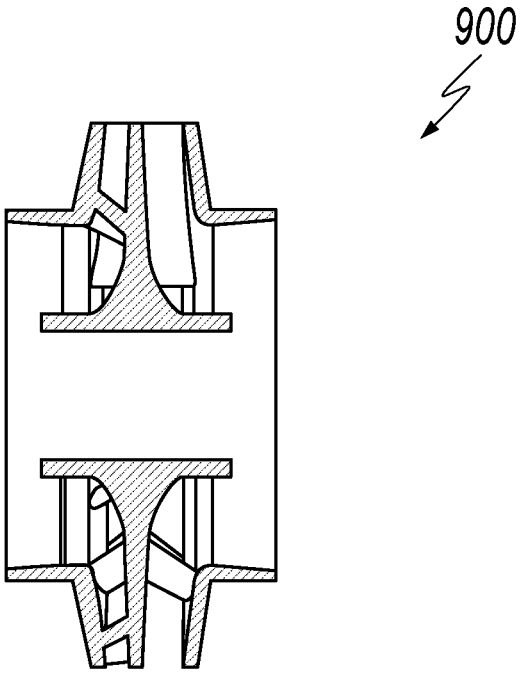
Figure 11D:
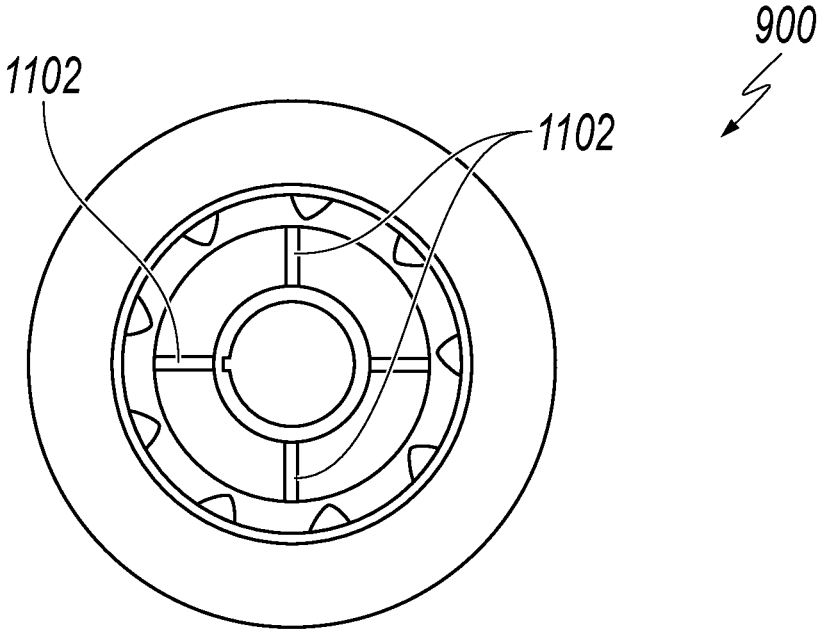
Figure 11E:
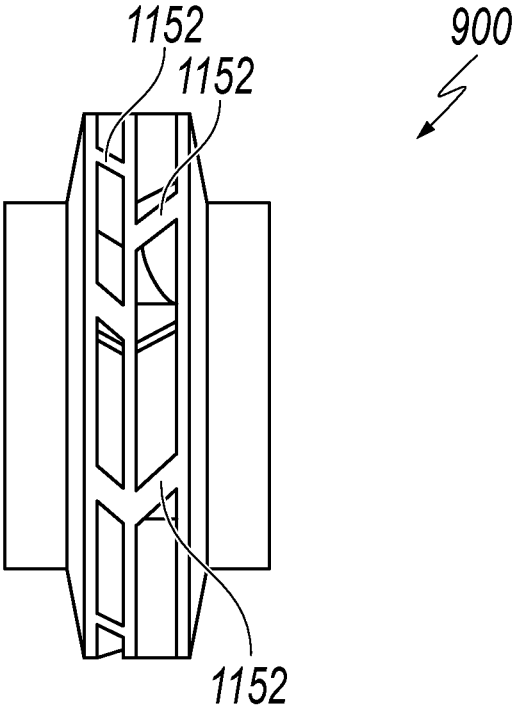
Figure 11F:
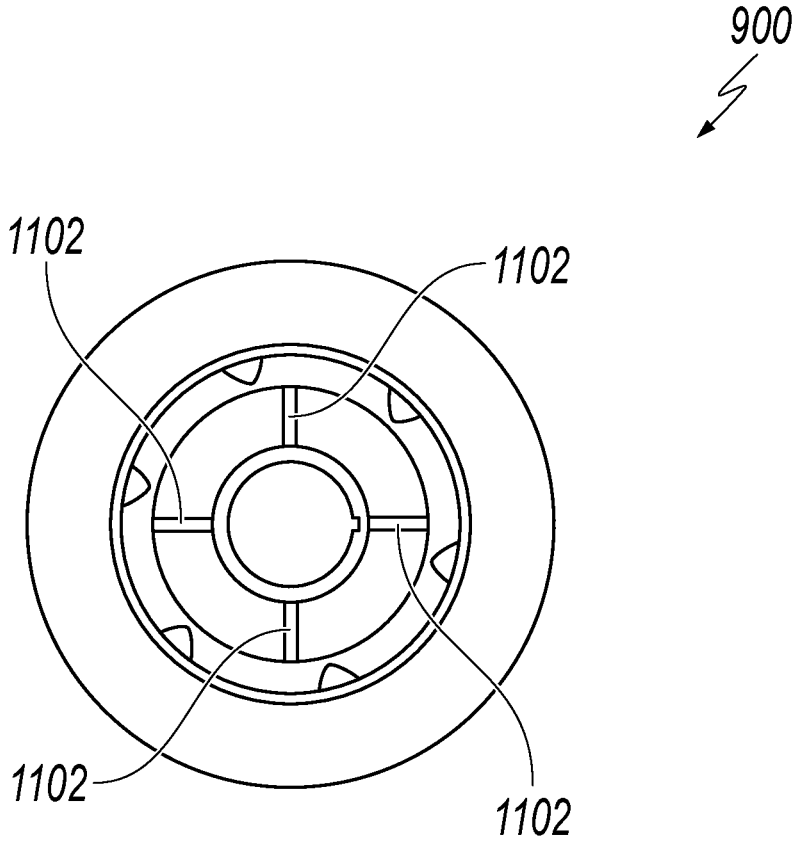

FIG. 11A is a plan view of a split blade impeller 1102. The impeller 1102 includes vanes 1106 that extend radially in a curved fashion from a central hub 1108. The vanes 1106 include an inner section 1110 and an outer section 1112. Balance holes 1104 are formed through the impeller 1102 and facilitate balance of pressure between a first side of the impeller 1102 and a second side of the impeller 1102.

Figure 12:
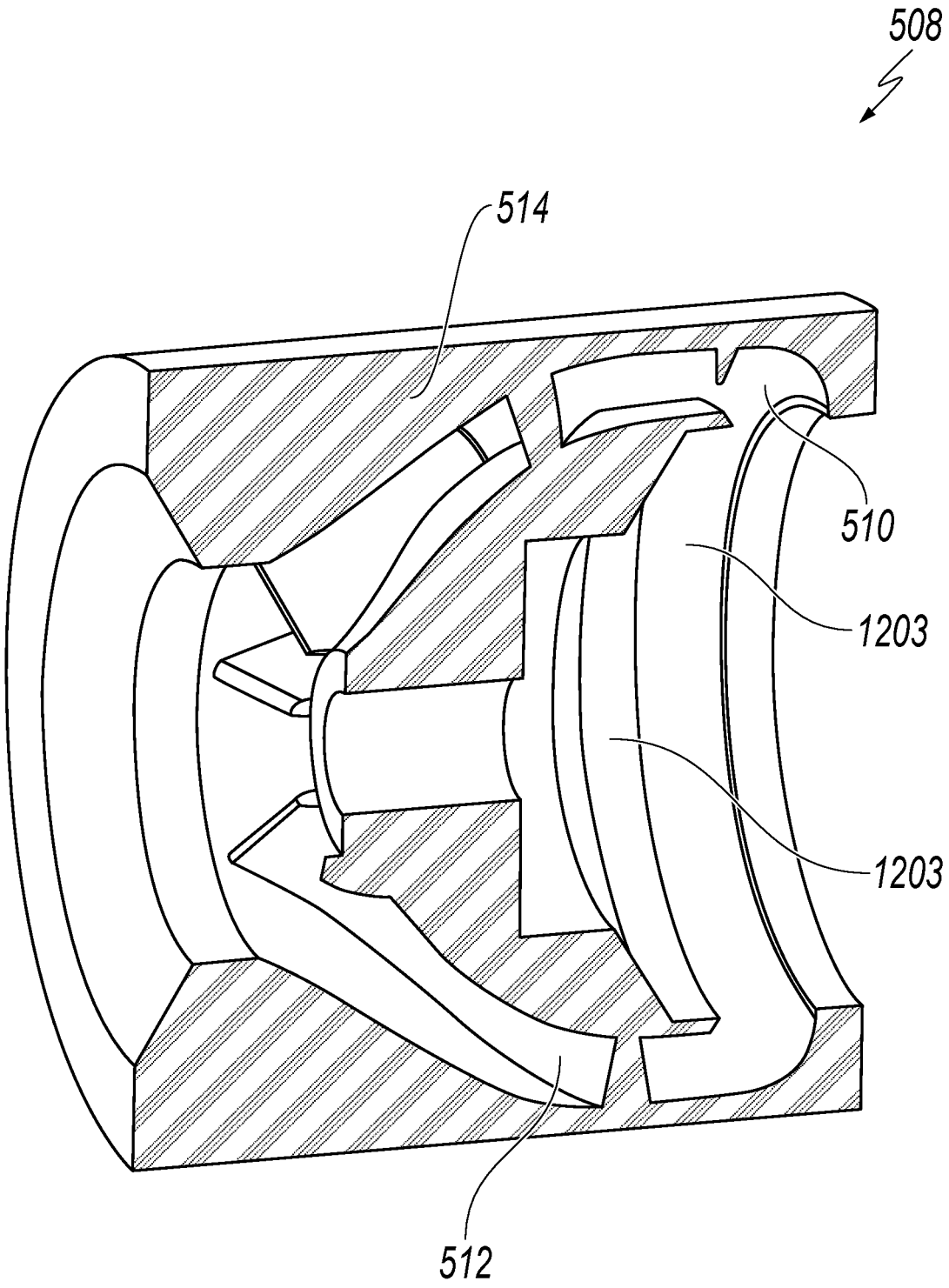
FIG. 12 is a cross-sectional view of a diffuser according to aspects of the disclosure.

FIG. 12 is a cross-sectional view of the diffuser 508. In various embodiments, the diffuser 508 is used as an alternative to a diffuser for single-stage pumps and compressors. The diffuser 508 includes a fluid passage 510 having a plurality of vanes 512 formed therein. In use, the diffuser 508 receives the impeller therein. In various embodiments, the fluid passage 510 includes a diffuser shroud 514, a hub 516, and surfaces 1203 to accommodate the impeller and to facilitate fluid transmission.

Figure 13A:
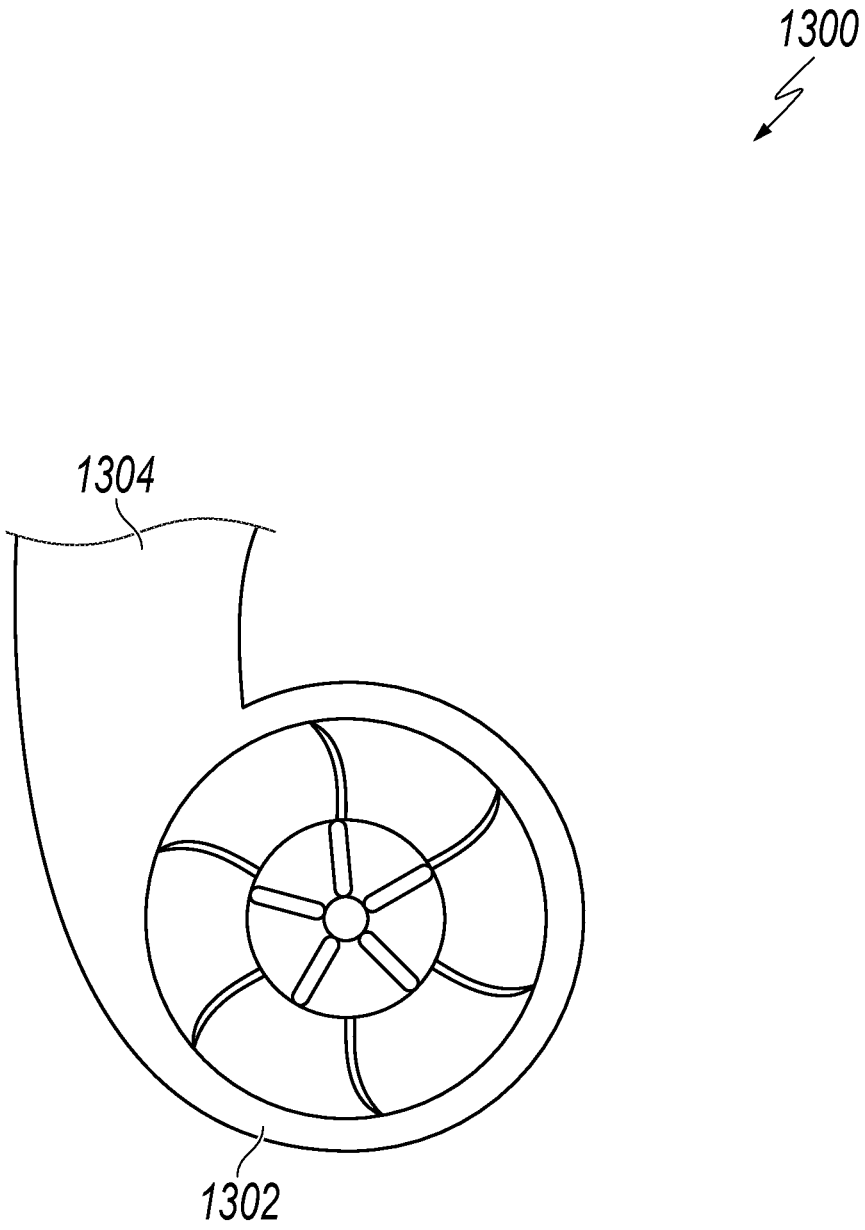
FIG. 13A is a plan view of a volute according to aspects of the disclosure.
Figure 13B:
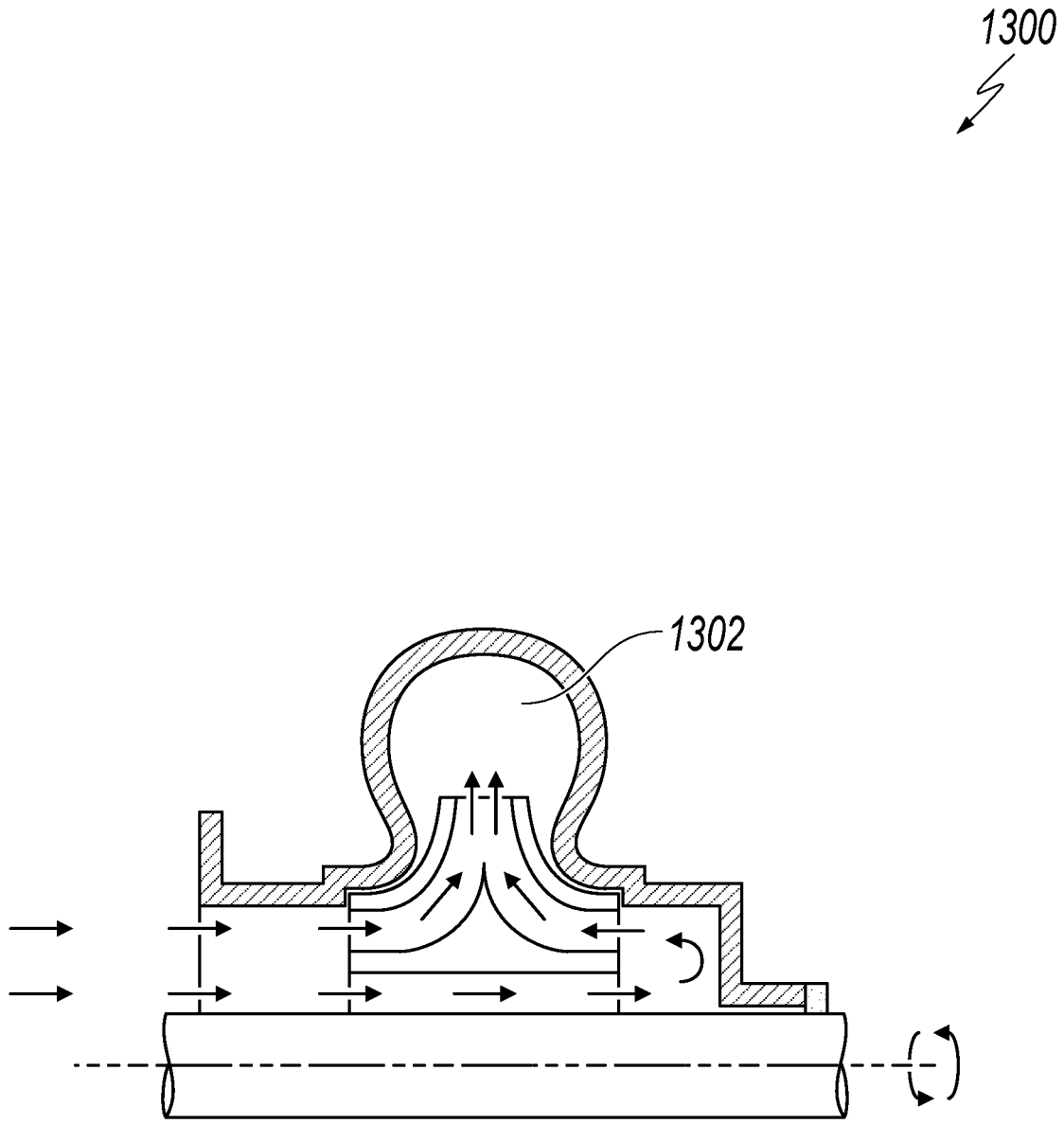
FIG. 13B is a cross sectional view of the volute of FIG. 13A.

FIG. 13A is a plan view of a volute 1300 FIG. 13B is a cross sectional view of the volute 1300. The volute 1300 is typically used with a power-absorbing turbomachine such as, for example, a pump and is a casing that receives an impeller such as, for example, the impeller 502. The volute 1300 includes a fluid passage 1302. In various embodiments, the fluid passage 1302 has the shape of a curved funnel to facilitate fluid transmission. The fluid passage 1302 increases in cross-sectional area as it approaches a discharge port 1304.

Figure 14A:
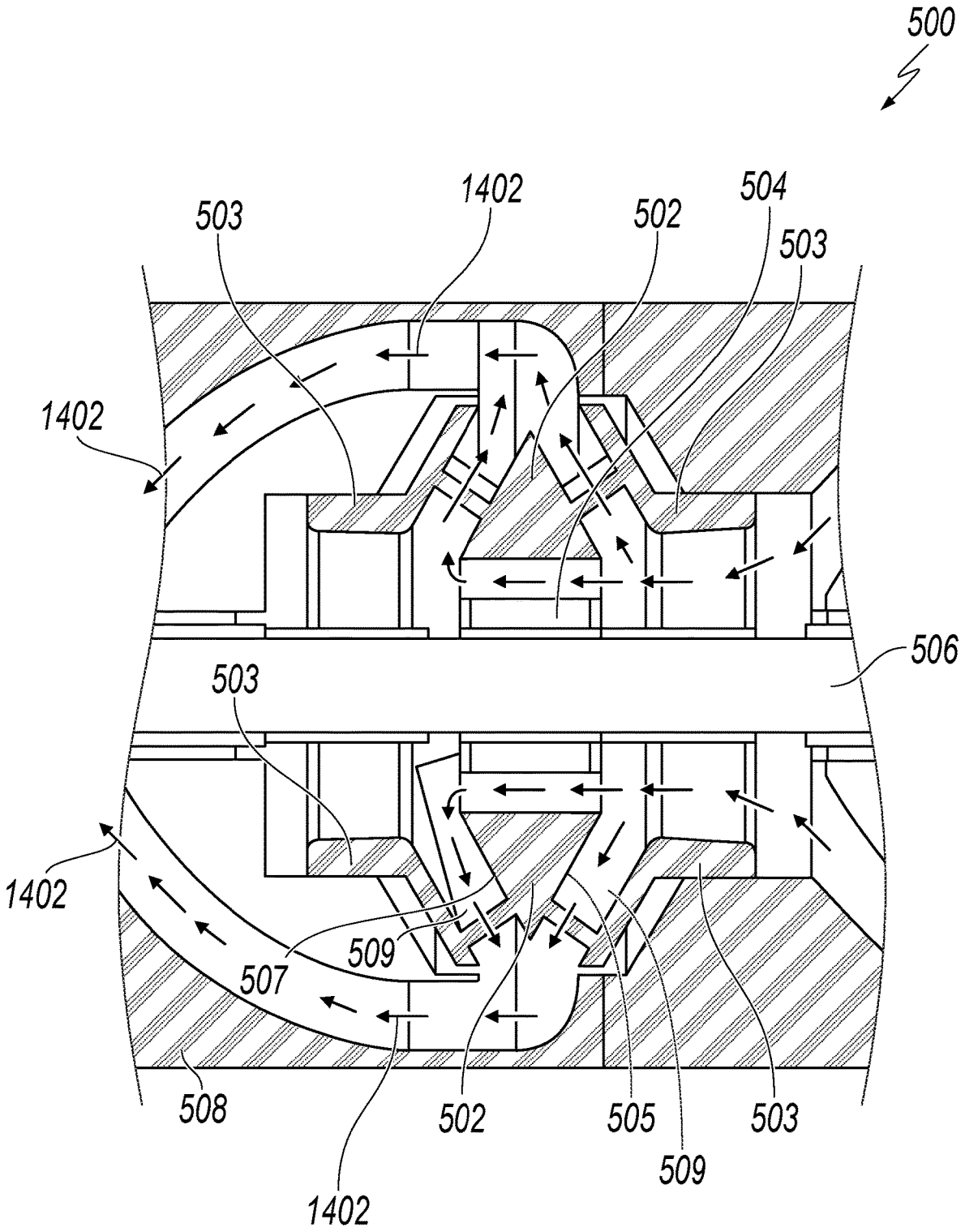
FIG. 14A is a cross-sectional view of the turbomachine of FIG. 5 illustrating fluid flow therethrough according to aspects of the disclosure.

FIG. 14A is a cross-sectional view of the turbomachine 500 illustrating fluid flow therethrough. In the embodiment shown in FIG. 14A, the turbomachine 500 is a power-absorbing turbomachine such as, for example, a compressor or a pump. Fluid flow through the turbomachine 500 is illustrated by arrows 1402. During operation, fluid enters the impeller 502 axially via an annular passage defined between the impeller shroud 503 and the shaft 506. A first portion of the fluid is directed through the vanes 509 on a first side 505 of the impeller 502. A second portion of the fluid is directed through the annular passage 504 to a second side 507 of the impeller 502. The impeller vanes 509 direct the fluid on the first side 505 of the impeller 502 and the fluid on the second side 507 of the impeller 502 in a radial direction to the diffuser 508. The fluid exits the impeller 502 radially and enters the diffuser 508. By introducing fluid to both the first side 505 and the second side 507 of the impeller 502, pressure is balanced on the impeller 502 thereby reducing axial thrust on the shaft 506.

Figure 14B:
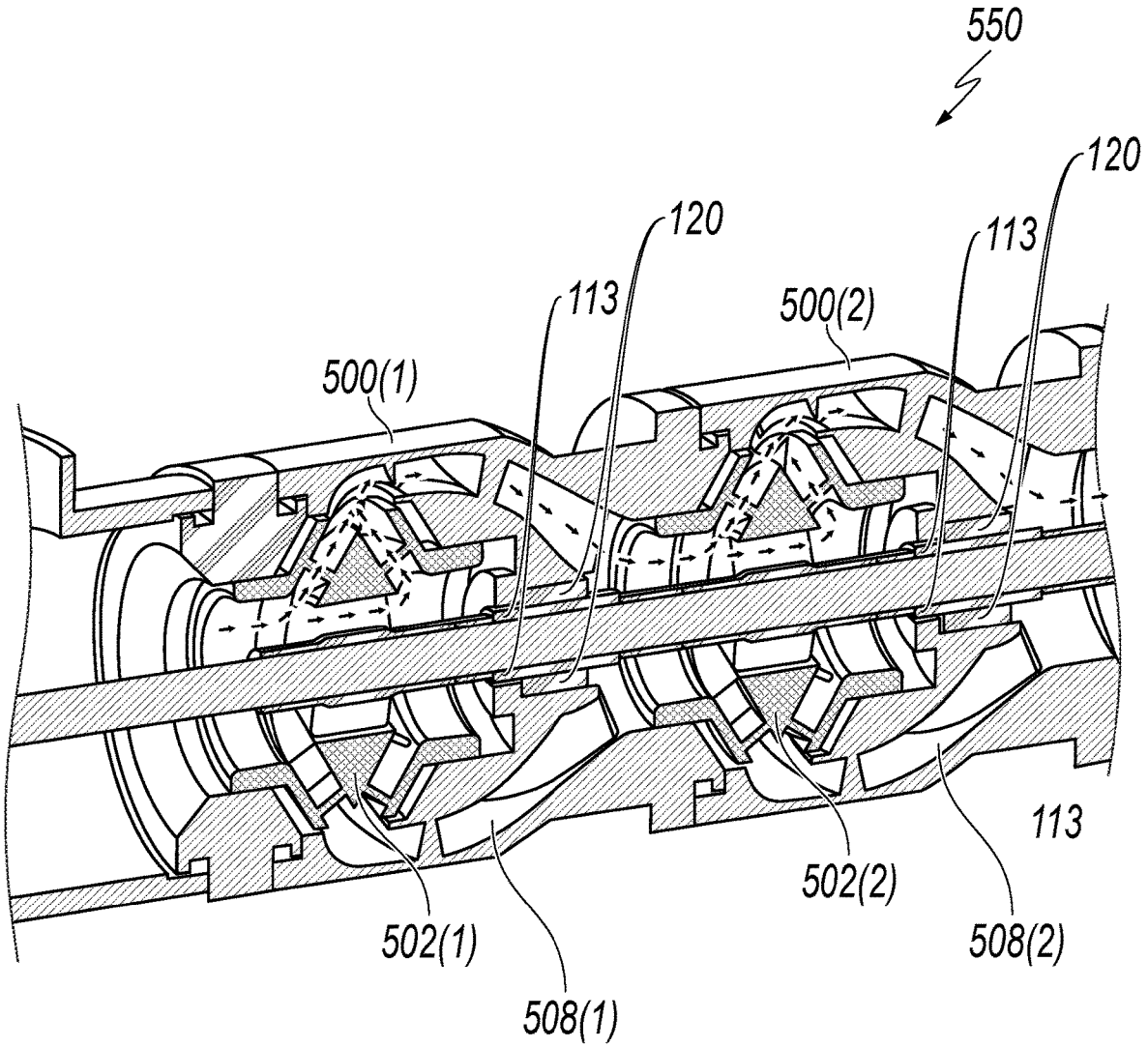
FIG. 14B is a cross-sectional view of the turbomachine of FIG. 14A illustrating multiple stages.

FIG. 14B is a cross-sectional view of a turbomachine 550 illustrating multiple stages. In the embodiment shown in FIG. 14B, the turbomachine 550 includes multiple turbomachines 500(1)-(2) that are coupled in series such that the fluid exiting the diffuser 508(1) of the first turbomachine 500(1) enters the impeller 502(2) of the second turbomachine 500(2). By way of example, the turbomachine 550 is illustrated in FIG. 14B as including two stages (turbomachines 500(1)-(2)); however, in other embodiments, the turbomachine 550 may include any number of stages as dictated by design requirements. By way of example, the turbomachine is illustrated in FIG. 14B as a compressor or a pump such that fluid enters the impellers 502(1)-(2) in an axial direction and exits the impellers 502(1)-(2) in a radial direction. In other embodiments, the turbomachine 550 may operate as a turbine such that fluid enters the impellers 502(1)-(2) in a radial direction and exits the impellers 502(1)-(2) in an axial direction.

Figure 15:
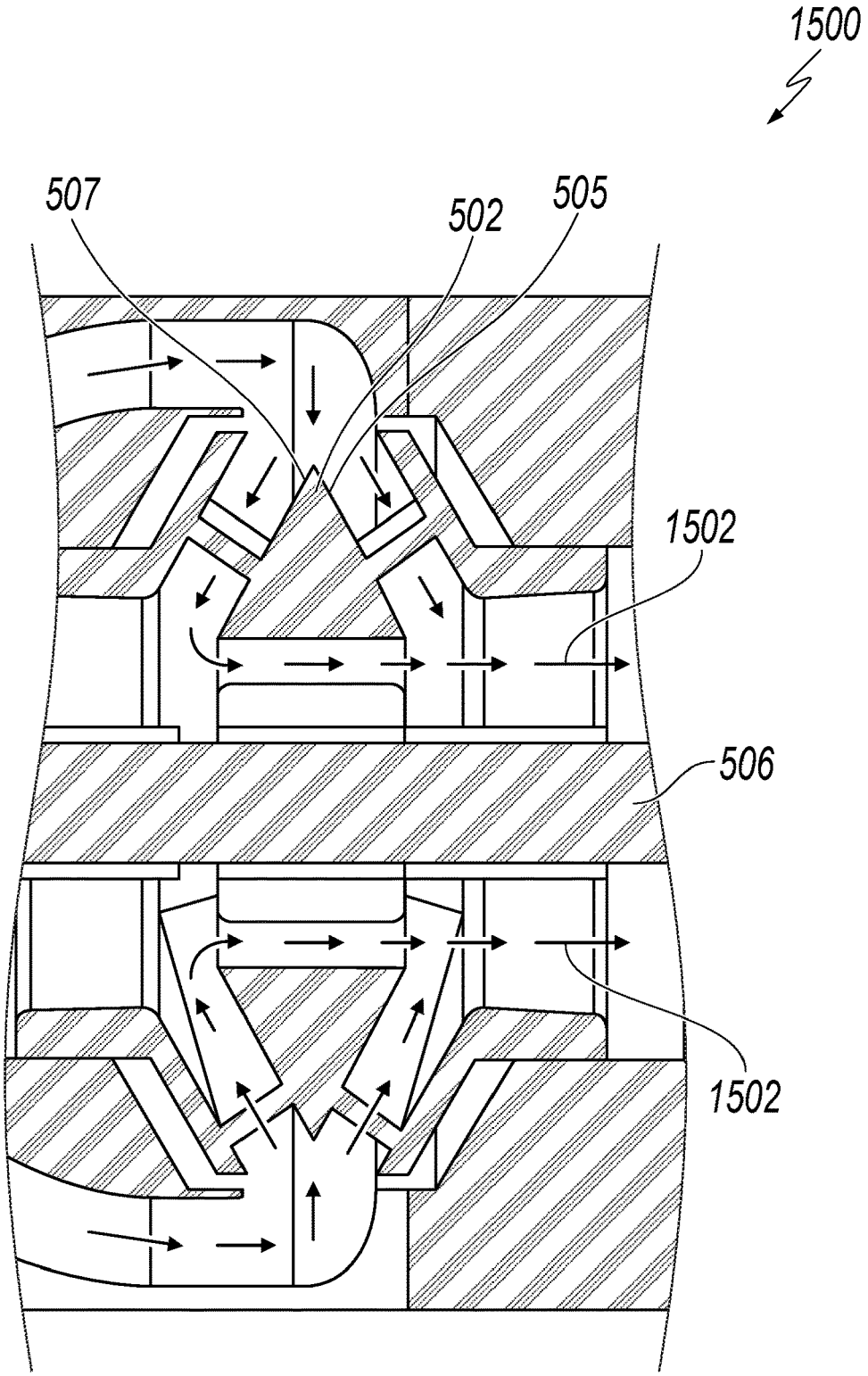
FIG. 15 is a cross sectional view of a hydraulic turbine illustrating fluid flow therethrough according to aspects of the disclosures.

FIG. 15 is a cross sectional view of the turbomachine 1500 illustrating fluid flow therethrough. In the embodiment shown in FIG. 15, the turbomachine 1500 is a power-producing turbomachine such as, for example, a hydraulic turbine. Fluid flow through the turbomachine 1500 is illustrated by arrows 1502. The turbomachine 1500 functions similar to the turbomachine 500 (shown in FIGS. 5-7) except that fluid enters the turbomachine 1500 radially and exits the turbomachine 1500 axially. Upon entering the impeller 502 axially, the fluid is divided onto the first side 505 and the second side 507 of the impeller 502. By introducing fluid to both the first side 505 and the second side 507 of the impeller 502, pressure is balanced on the impeller 502 thereby reducing axial thrust on the shaft 506.

Figure 16:
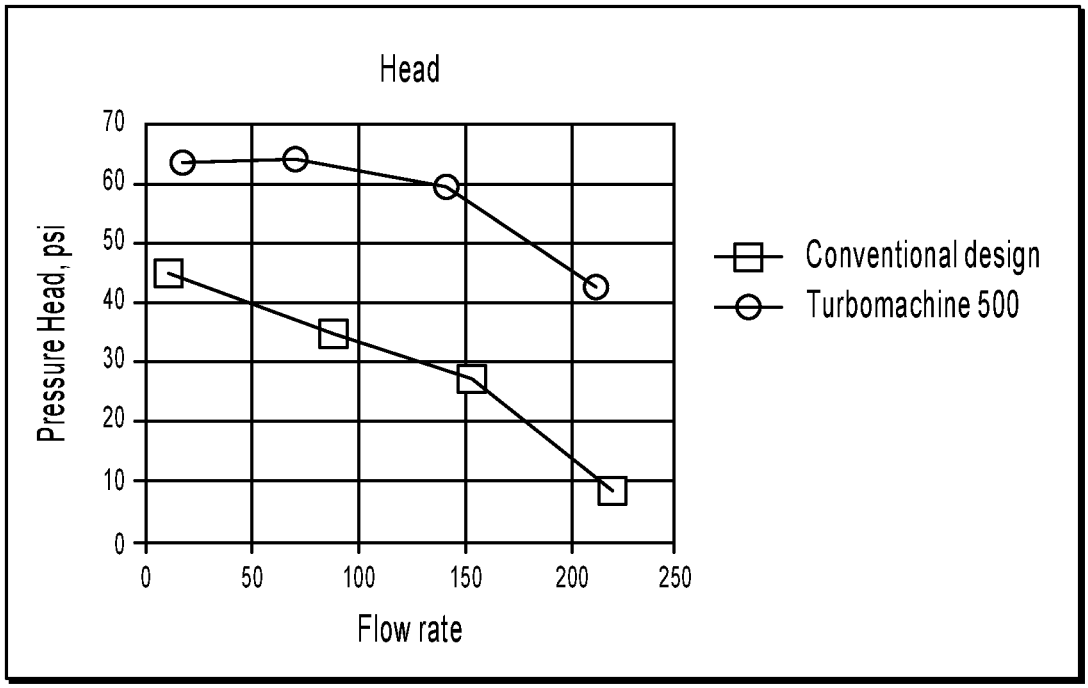
FIG. 16 is a graph relating pressure head to flow rate for turbomachine according to aspects of the disclosure.
Figure 17:
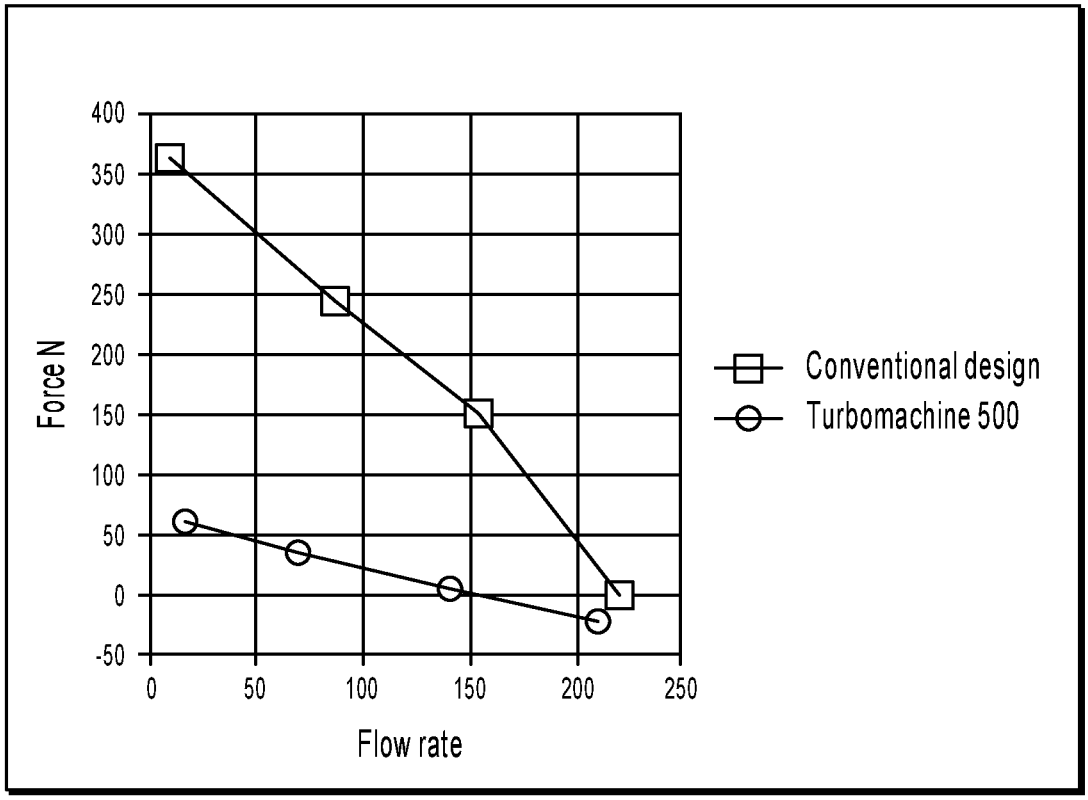
FIG. 17 is a graph relating thrust to flow rate for a turbomachine according to aspects of the disclosure.

Simulations were performed to understand the performance as well as forces acting on the impeller. Simulations were performed for varying speeds ranging from 3,600 rpm to 30,000 rpm. The results are compared with conventional stages. FIG. 16 shows the head developed for a range of flow rates during use of the turbomachine 500. FIG. 17 shows thrust as a function of flow rate during use of the turbomachine 500. Data according to various embodiments is based on higher speed compared to the conventional design simulations, which is reflected in the higher pressure head values for the turbomachine 500 due to higher rotational speeds, yet the thrust values for the turbomachine 500 are significantly lower compared to the thrust values for conventional design. In various embodiments, the turbomachine 500 could have any specific speed. Specific speed is calculated according to equation 1.

$$\text{Specific speed} = \text{Rotational speed} * \sqrt{\text{flowrate}} / \text{Head}^{0.75} \qquad \text{Equation 1}$$

Figure 18:
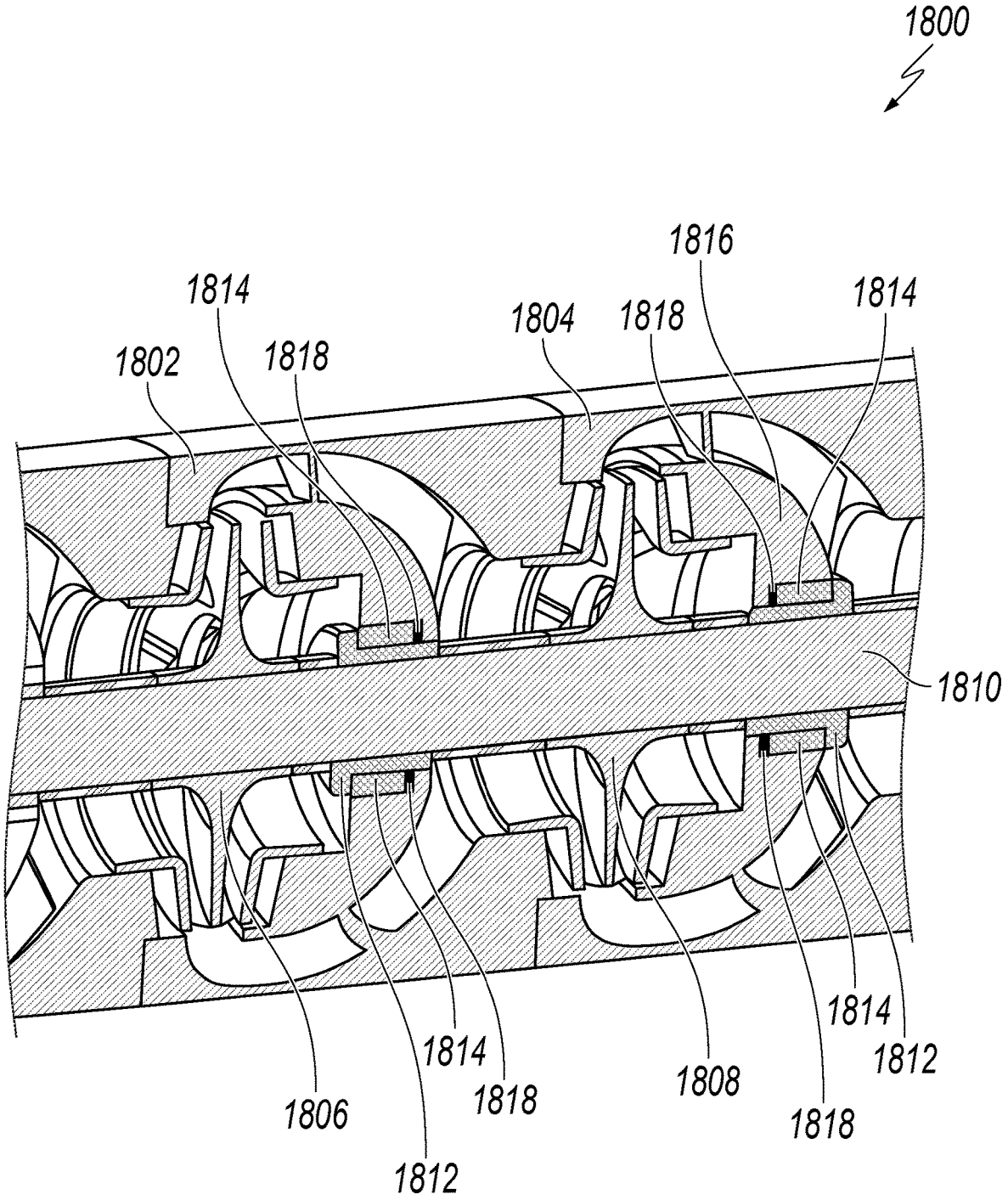
FIG. 18 is a cross-sectional view of a turbomachine illustrating interstage bearing supports.

FIG. 18 is a cross-sectional view of a turbomachine 1800 illustrating bearing supports 1814. The turbomachine 1800 includes a first stage 1802 and a second stage 1804. The first stage 1802 includes a first impeller 1806 and the second stage includes a second impeller 1808. The first impeller 1806 and the second impeller 1808 are driven by a shaft 1810. The shaft 1810 includes means for support. In various embodiments, the means for support includes a journal 1812 disposed on the shaft 1810 and that rotates with the shaft 1810. In such embodiments, the means for support further includes a bushing 1814 that is disposed in a diffuser 1816. During operation, rotation of the shaft 1810 causes the journal 1812 to rotate within the bushing 1814. A thrust washer 1818 abuts the bushing 1814 and is disposed between the bushing 1814 and the diffuser 1816. In various embodiments, the thrust washer 1818 is constructed of a material that is softer than the bearing support 1814. In various embodiments, the bushing 1814 is constructed of a material such as, for example, tungsten carbide, silicon carbide, diamond-coated tungsten carbide, diamond-coated silicon carbide, or any other appropriate material. The thrust washer 1818 is constructed of a material such as, for example, phenolic. The bushing 1814 and the thrust washer 1818 facilitate support of radial force as well as axial force. During operation, pressure head resulting from changes in fluid flow rate can create reactive axial thrust. The thrust washer 1814 allows the turbomachine 1800 to bear this load and balances residual forces.

Figure 19:
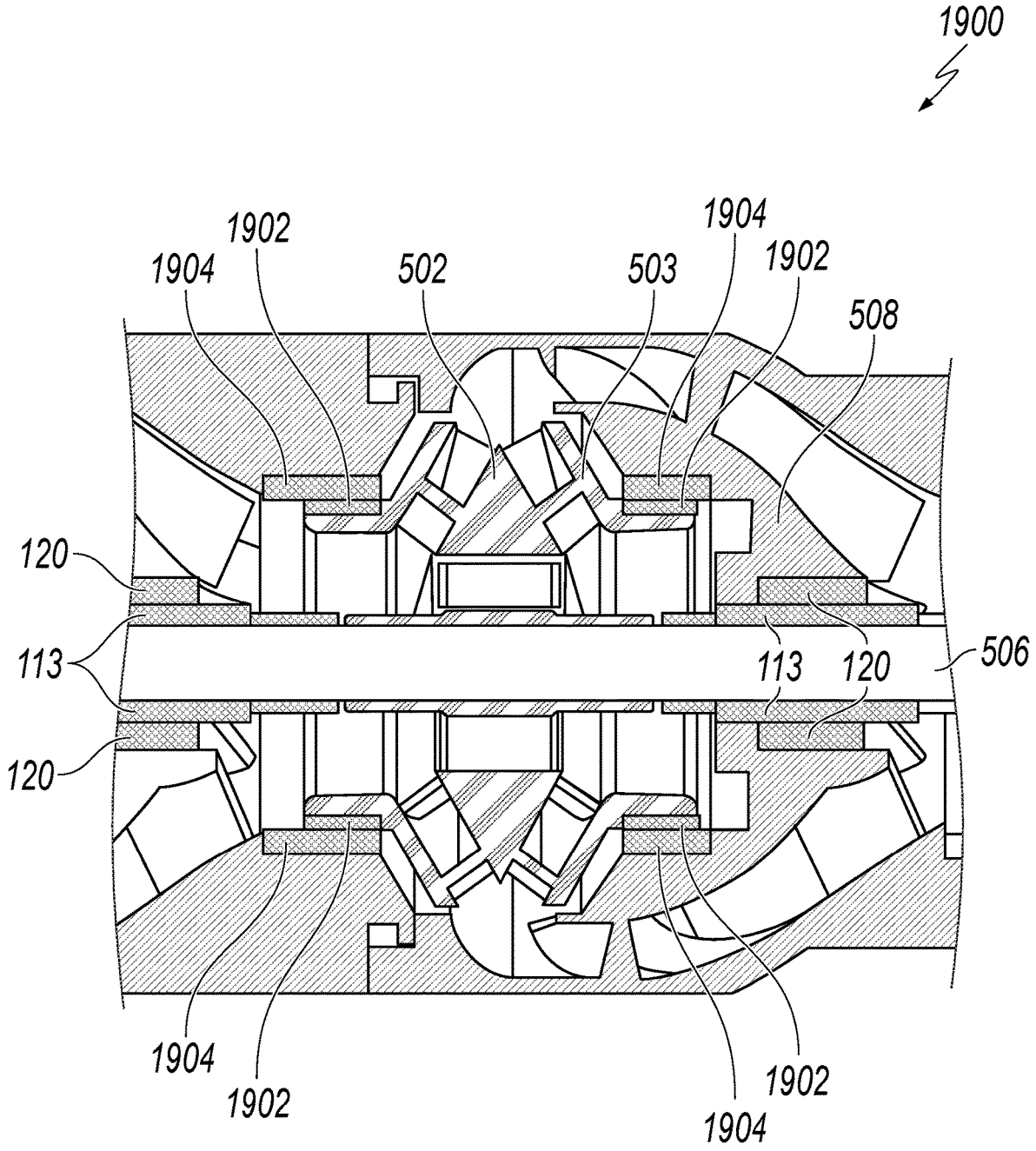
FIG. 19 is a cross-sectional view of a turbomachine illustrating impeller-mounted bearing supports.

FIG. 19 is a cross-sectional view of a turbomachine 1900 showing bearing supports disposed on the impeller shroud 503 and the diffuser 508. During use, the journals 113 and bushings 120 installed on the shaft 506 wear out with time. Wear of the journals 113 and bushings 120 causes the seal between the impeller shroud 503 and the diffuser 508 to act as a bearing. In an effort to mitigate wear, means for impeller support are installed on the impeller shroud 503 and the diffuser 508. In various embodiments, the means for impeller support include a bearing support 1902 that is installed about an outer circumference of the impeller shroud 503. The bearing support 1902 contacts and bears against a bearing support 1904 installed in an inner circumference of the diffuser 508 In various embodiments, the bearing support 1902 and the bearing support 1904 support radial loading of the impeller 502 and reduce wear on the impeller 502 and the impeller shroud 503. In various embodiments, the bearing support 1902 and the bearing support 1904 are constructed of any appropriate material such as, for example, carbides, peek, and thermoplastics.

Figure 20:
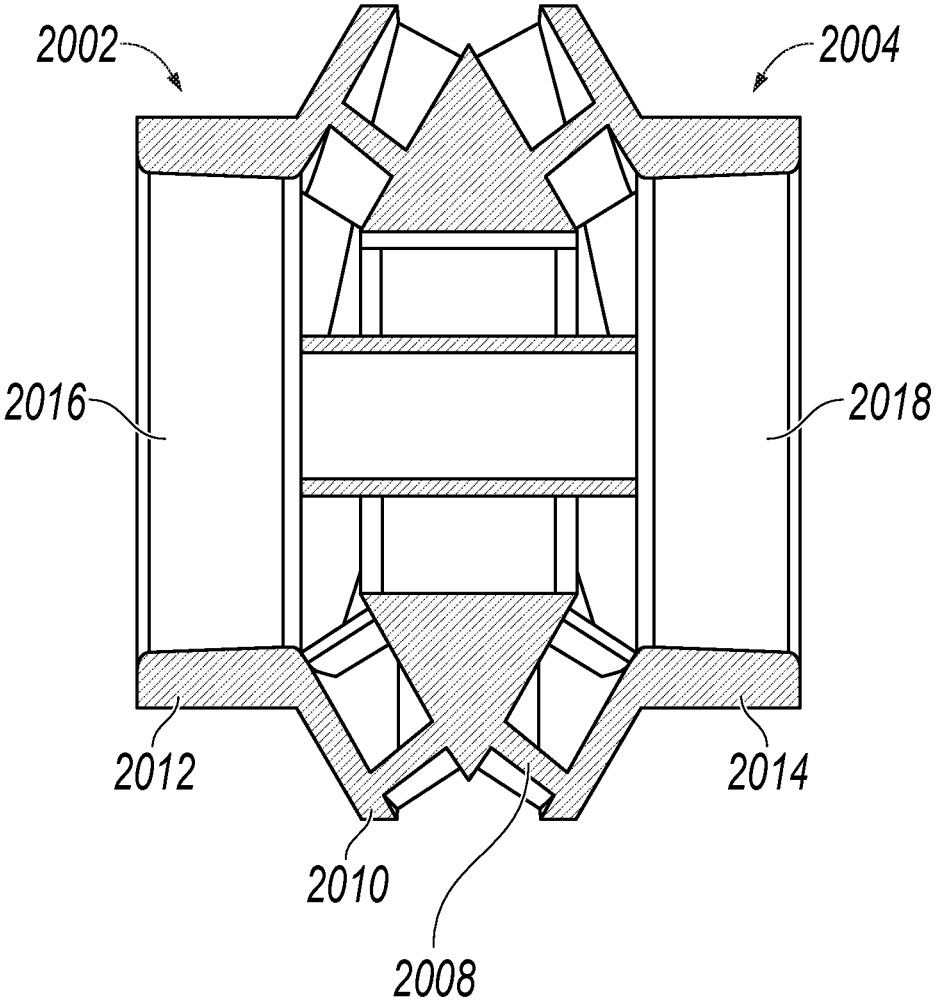
FIG. 20 is a cross-sectional view of an exemplary impeller having different diffuser skirt diameters.

FIG. 20 is a cross-sectional view of an impeller 2000. The impeller 2000 includes a first side 2002 and a second side 2004. A plurality of vanes 2008 extend from the first side 2002 and the second side 2004. An impeller shroud 2010 is disposed in a spaced relationship with the first side 2002 and the second side 2004 so as to cover the vanes 2008. The impeller shroud 2010 includes a first skirt 2012 formed on the first side 2002 and a second skirt 2014 formed on the second side 2004. The first skirt 2012 forms a first axial opening 2016, which has a first outer diameter of Do1 and a first inner diameter of Di1. The second skirt 2014 forms a second axial opening 2018, which has a first outer diameter of Do2 and a first inner diameter of Di2. In various embodiments, the first outer diameter Do1 may differ from the second outer diameter Do2. Likewise, the first inner diameter Di1 may differ from the second inner diameter Di2. In various embodiments, differing diameters of the first axial opening 2016 and the second axial opening 2018 facilitates control of thrust acting on the impeller 2000 during operation.

The term "substantially" is defined as largely but not necessarily wholly what is specified (and includes what is specified; e.g., substantially 90 degrees includes 90 degrees and substantially parallel includes parallel), as understood by a person of ordinary skill in the art. In any disclosed embodiment, the terms "substantially," "approximately," "generally," and "about" may be substituted with "within a percentage of" what is specified.

Depending on the embodiment, certain acts, events, or functions of any of the algorithms described herein can be performed in a different sequence, can be added, merged, or left out altogether (e.g., not all described acts or events are necessary for the practice of the algorithms). Moreover, in certain embodiments, acts or events can be performed concurrently, e.g., through multi-threaded processing, interrupt processing, or multiple processors or processor cores or on other parallel architectures, rather than sequentially. Although certain computer-implemented tasks are described as being performed by a particular entity, other embodiments are possible in which these tasks are performed by a different entity.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

While the above detailed description has shown, described, and pointed out novel features as applied to various embodiments, it will be understood that various omissions, substitutions, and changes in the form and details of the devices or algorithms illustrated can be made without departing from the spirit of the disclosure. As will be recognized, the processes described herein can be embodied within a form that does not provide all of the features and benefits set forth herein, as some features can be used or practiced separately from others. The scope of protection is defined by the appended claims rather than by the foregoing description. All changes which come within the meaning and range of equivalency of the claims are to be embraced within their scope.

What is claimed is:

1. A turbomachine, comprising:

a housing having an inlet and an outlet;

a shaft rotationally disposed in the housing, the shaft being rotatable about a longitudinal axis;

an impeller coupled to the shaft between the inlet and the outlet and rotating with the shaft, the impeller comprising an impeller shroud, a first set of vanes disposed on a first side of the impeller and configured to generate axial thrust in a first direction, and a second set of vanes disposed on a second side of the impeller and configured to generate axial thrust in a second direction that is opposite the first direction, the impeller and the impeller shroud forming a single impeller inlet and an impeller outlet;

a passage formed through a thickness of the impeller, the passage configured to facilitate transmission of a fluid from the first side of the impeller to the second side of the impeller such that the fluid is supplied to the first set of vanes and the second set of vanes via the single impeller inlet; and wherein transmission of the fluid through the impeller reduces net axial thrust imparted to at least one of the impeller and the shaft.

2. The turbomachine of claim 1, comprising a diffuser assembly configured to house the impeller, the diffuser assembly comprising:

a flow passage having vanes;

a diffuser shroud, wherein the diffuser shroud is configured to house the impeller and to direct flow of the fluid to at least a second stage of the turbomachine; and a hub to facilitate fluid transmission.

3. The turbomachine of claim 2, wherein an axial clearance is formed between the impeller shroud and the diffuser shroud so as to isolate a high pressure region of the turbomachine from a low pressure region of the turbomachine.

4. The turbomachine of claim 1, wherein:

the turbomachine is power-absorbing;

the turbomachine is incorporated into at least one of a multistage electrical submersible pumping system and a gas compression system; and the single impeller inlet is an axial inlet and the impeller outlet is at least one of a radial outlet.

5. The turbomachine of claim 1, wherein the turbomachine is power producing.

6. The turbomachine of claim 5, wherein the single impeller inlet is a radial inlet and the impeller outlet is an axial outlet.

7. The turbomachine of claim 1 comprising a volute configured to house the impeller, the volute comprising a curved funnel flow passage to facilitate fluid transmission.

8. The turbomachine of claim 1, wherein:

a vane inlet angle of the first set of vanes on the first side of the impeller and a vane inlet angle of the second set of vanes on the second side of the impeller are equal; and a vane exit angle of the first set of vanes on the first side of the impeller and a vane exit angle of the second set of vanes on the second side of the impeller are equal.

9. The turbomachine of claim 1, wherein at least one of a vane profile, a vane shape, and a vane size of the first set of vanes on the first side of the impeller is different than at least one of a vane profile, a vane shape, and a vane size of the second set of vanes on the second side of the impeller.

10. An impeller for use in a turbomachine, the impeller comprising:

a first side having a first set of vanes disposed thereon, the first set of vanes configured to generate axial thrust in a first direction;

a second side having a second set of vanes disposed thereon, the second side being arranged opposite the first side, the second set of vanes configured to generate axial thrust in a second direction that is opposite the first direction;

an impeller shroud disposed around and spaced from the first side and the second side, the impeller shroud defining a single fluid inlet and a fluid outlet; and a passage formed through a thickness of the impeller, the passage configured to facilitate transmission of fluid from the first side of the impeller to the second side of the impeller such that fluid is supplied to the first set of vanes and the second set of vanes via a single impeller inlet.

11. The impeller of claim 10, comprising:

at least one rib disposed in the passage; and wherein the at least one rib comprises a helical shape.

12. The impeller of claim 10, wherein:

a vane inlet angle of the first set of vanes on the first side of the impeller and a vane inlet angle of the second set of vanes on the second side of the impeller are equal; and a vane exit angle of the first set of vanes on the first side of the impeller and a vane exit angle of the second set of vanes on the second side of the impeller are equal.

13. The impeller of claim 10, wherein at least one of a vane profile, a vane shape, and a vane size of the first set of vanes on the first side of the impeller is different than at least one of a vane profile, a vane shape, and a vane size of the second set of vanes on the second side of the impeller.

14. The impeller of claim 13, wherein:

the first side of the impeller is configured to transmit a first fluid phase; and the second side of the impeller is configured to transmit a second fluid phase distinct from the first fluid phase.

15. The impeller of claim 10, wherein the first set of vanes on the first side of the impeller are offset from the second set of vanes on the second side of the impeller.

16. The impeller of claim 10, wherein the single fluid inlet is an axial inlet and the fluid outlet is a radial outlet.

17. The impeller of claim 10, wherein the single fluid inlet is a radial inlet and the fluid outlet is an axial outlet.

18. A method of reducing axial thrust on an impeller shaft, the method comprising:

directing a fluid onto a first side of an impeller having a first set of vanes and a second side of the impeller having a second set of vanes via a single impeller inlet, the single impeller inlet being defined by an impeller shroud disposed around and in a spaced relationship with the first side of the impeller and the second side of the impeller;

expelling the fluid from the impeller via an impeller outlet, wherein the first set of vanes are configured to generate axial thrust in a first direction and the second set of vanes are configured to generate axial thrust in a second direction that is opposite the first direction; and wherein the fluid passes through a passage formed through a thickness of the impeller prior to contacting the second set of vanes.

19. The method of claim 18, wherein the single impeller inlet is a radial inlet and the impeller outlet is an axial outlet.

20. The method of claim 18, wherein the single impeller inlet is an axial inlet and the impeller outlet is a radial outlet.

* * * * *